US012735980B1

(12) United States Patent
Jegbefume et al.

(10) Patent No.: US 12,735,980 B1
(45) Date of Patent: Sep. 15, 2026

(54) SYSTEMS AND METHODS FOR ESTIMATING DEPTH OF WELLBORE SURVEY MEASUREMENTS

(71) Applicant: Schlumberger Technology Corporation, Sugar Land, TX (US)

(72) Inventors: Onyemelem Jegbefume, Katy, TX (US); Adrian Guillermo Ledroz, Katy, TX (US); Jon Bang, Sandsli (NO)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 19/277,785

(22) Filed: Jul. 23, 2025

(51) Int. Cl.

| | |
|---|---|
| ***E21B 47/09*** | (2012.01) |
| ***E21B 17/10*** | (2006.01) |
| ***E21B 47/022*** | (2012.01) |
| ***E21B 47/04*** | (2012.01) |

(52) U.S. Cl.
CPC ..... *E21B 47/09* (2013.01); *E21B 17/1078* (2013.01); *E21B 47/022* (2013.01); *E21B 47/04* (2013.01)

(58) Field of Classification Search
CPC ..... E21B 47/04; E21B 47/09; E21B 17/1078
See application file for complete search history.

(56) References Cited

U.S. PATENT DOCUMENTS

| | | | | |
|---|---|---|---|---|
| 4,515,403 A * | 5/1985 | Cheek | E21B 23/00 294/86.31 |
| 5,566,762 A * | 10/1996 | Braddick | E21B 23/01 166/117.6 |
| 6,145,378 A * | 11/2000 | McRobbie | E21B 47/04 175/45 |
| 10,781,691 B2 | 9/2020 | Ledroz | |
| 11,125,076 B1 * | 9/2021 | Zeghlache | E21B 47/092 |

* cited by examiner

*Primary Examiner* — Kristyn A Hall
(74) *Attorney, Agent, or Firm* — Jeffrey D. Frantz

(57) ABSTRACT

A method for estimating depth of a survey tool during a wellbore survey, the method comprising dropping the survey tool inside a drill pipe placed in a wellbore, generating, by an accelerometer included in the survey tool, a measurement signal as the survey tool moves through the drill pipe, identifying a first group of spikes appearing in the measurement signal, identifying a second group of spikes appearing in the measurement signal, and determining a depth of the survey tool at a first time during movement of the survey tool through the drill pipe based in part on the first group of spikes, the second group of spikes, and a dimension of the drill pipe.

16 Claims, 20 Drawing Sheets

SYSTEMS AND METHODS FOR ESTIMATING DEPTH OF WELLBORE SURVEY MEASUREMENTS

FIELD

The present disclosure relates to wellbore surveying, and more specifically, systems and methods for estimating depth of wellbore survey measurements.

BACKGROUND

In the oil and gas industry, wellbore surveying refers to the process of measuring and determining the trajectory of a wellbore drilled into the subsurface. In one conventional approach to wellbore surveying, a survey tool is dropped inside a drill pipe laid in the wellbore. As the survey tool traverses the drill pipe towards the bottom hole assembly (BHA), accelerometers and/or gyroscopes included in the survey tool generate measurements that can be used to determine orientation information (e.g., azimuth, inclination, toolface orientation angle, etc.) associated with the survey tool. For example, the gyroscopes and/or accelerometers in the survey tool generate measurements that can be used to determine a continuous azimuth and inclination (e.g., direction and angle) of the survey tool traversing the drill pipe. In addition, with this conventional approach, the depth of the survey tool can be estimated based on an assumption that the survey tool moves through the drill pipe at a constant speed. Then, by mapping the estimated depth values to the continuous azimuth and inclination of the survey tool moving through the drill pipe, this conventional approach can be used to determine a trajectory of the wellbore.

At least one drawback to this conventional approach, however, is that the techniques used to estimate, or determine, the depth of the survey tool can be inaccurate. For example, as described above, the techniques used to determine the depth of the survey tool dropped inside the drill pipe rely on an assumption that the survey tool moves through the drill pipe at a constant speed. This assumption is incorrect, as the speed of the survey tool can vary with inclination changes in the wellbore. Accordingly, depth(s) of the survey tool that were estimated based on the assumed constant speed are likely to be inaccurate, and thus, the depth(s) of the determined wellbore trajectory are likely to include inaccuracies.

As the foregoing illustrates, what is needed in the art are more effective techniques for estimating depth of wellbore survey measurements.

SUMMARY

In one independent aspect, a method for estimating depth of a survey tool during a wellbore survey. The method includes dropping the survey tool inside a drill pipe placed in a wellbore, generating, by an accelerometer included in the survey tool, a measurement signal as the survey tool moves through the drill pipe, identifying a first group of spikes appearing in the measurement signal, identifying a second group of spikes appearing in the measurement signal, and determining a depth of the survey tool at a first time during movement of the survey tool through the drill pipe based in part on the first group of spikes, the second group of spikes, and a dimension of the drill pipe.

In another independent aspect, a system comprising a drill pipe placed in a wellbore, the drill pipe including a segment of drill pipe connected between a first pipe joint and a second pipe joint, a survey tool adapted to be dropped inside the drill pipe, the survey tool including an axial accelerometer adapted to generate a measurement signal during movement of the survey tool through the drill pipe, and a computing device including one or more processors. The computing device is adapted to receive the measurement signal from the survey tool, identify a first group of spikes appearing in the measurement signal, identify a second group of spikes appearing in the measurement signal, and determine a depth of the survey tool at a first time during movement of the survey tool through the drill pipe based in part on the first group of spikes, the second group of spikes, and a dimension of the drill pipe.

In another independent aspect, a method for determining a trajectory of a wellbore. The method includes dropping a survey tool inside a drill pipe placed in the wellbore, generating, by a first sensor included in the survey tool, first measurement data as the survey tool moves through the drill pipe, generating, by a second sensor included in the survey tool, second measurement data as the survey tool moves through the drill pipe, retrieving the survey tool from the wellbore, identifying a first group of spikes appearing in the first measurement data, identifying a second group of spikes appearing in the first measurement data, determining a depth of the survey tool at a first time during movement of the survey tool through the drill pipe based in part on the first group of spikes, the second group of spikes, and a dimension of the drill pipe, determining an orientation of the survey tool at the first time during movement of the survey tool through the drill pipe based in part on the second measurement data, and determining the trajectory of the wellbore based in part on the depth of the survey tool at the first time and the orientation of the survey tool at the first time.

Other aspects will become apparent by consideration of the detailed description and accompanying drawings.

At least one technical advantage of the disclosed techniques relative to conventional approaches is that the depth of a survey tool can be estimated without relying on an assumed constant speed of the survey tool. Rather, with the disclosed techniques, one or more signal processing techniques can be used to determine the depth of the survey tool directly based on axial accelerometer measurements generated by a survey tool moving through the drill pipe. In that regard, with the disclosed techniques, more accurate depth values for the survey tool, and thus, more accurate wellbore trajectories can be determined.

DETAILED DESCRIPTION

Figure 1:
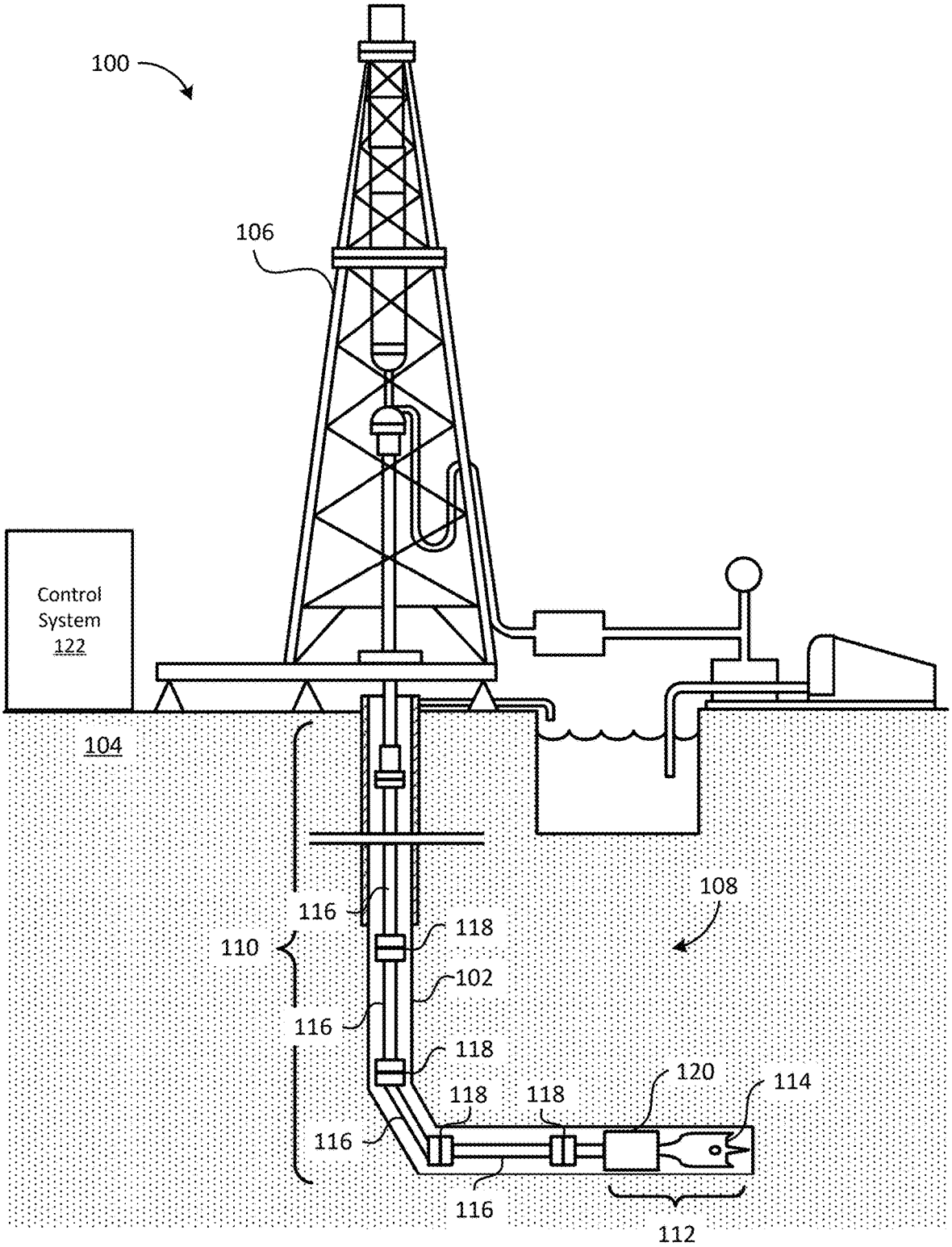
FIG. 1 illustrates an example drilling system, according to aspects of the various embodiments.

Before any embodiments are explained in detail, it is to be understood that the embodiments are not limited in their application to the details of the configuration and arrangement of components set forth in the following description or illustrated in the accompanying drawings. The embodiments are capable of being practiced or of being carried out in various ways. Also, it is to be understood that the phraseology and terminology used herein are for the purpose of description and should not be regarded as limiting. The use of "including," "comprising," or "having" and variations thereof are meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings.

In addition, it should be understood that embodiments may include hardware, software, and electronic components or modules that, for purposes of discussion, may be illustrated and described as if the majority of the components were implemented solely in hardware. However, one of ordinary skill in the art, and based on a reading of this detailed description, would recognize that, in at least one embodiment, the electronic-based aspects may be implemented in software (e.g., stored on non-transitory computer-readable medium) executable by one or more electronic processors, such as a microprocessor and/or application specific integrated circuits ("ASICs"). As such, it should be noted that a plurality of hardware and software-based devices, as well as a plurality of different structural components, may be utilized to implement the embodiments. For example, "servers," "computing devices," "controllers," "processors," etc., described in the specification can include one or more electronic processors, one or more computer-readable medium modules, one or more input/output interfaces, and various connections (e.g., a system bus) connecting the components.

Relative terminology, such as, for example, "about," "approximately," "substantially," etc., used in connection with a quantity or condition would be understood by those of ordinary skill to be inclusive of the stated value and has the meaning dictated by the context (e.g., the term includes at least the degree of error associated with the measurement accuracy, tolerances [e.g., manufacturing, assembly, use, etc.] associated with the particular value, etc.). Such terminology should also be considered as disclosing the range defined by the absolute values of the two endpoints. For example, the expression "from about 2 to about 4" also discloses the range "from 2 to 4." The relative terminology may refer to plus or minus a percentage (e.g., 1%, 5%, 10%, or more) of an indicated value.

Functionality described herein as being performed by one component may be performed by multiple components in a distributed manner. Likewise, functionality performed by multiple components may be consolidated and performed by a single component. Similarly, a component described as performing particular functionality may also perform additional functionality not described herein. For example, a device or structure that is "configured" in a certain way is configured in at least that way but may also be configured in ways that are not explicitly listed.

FIG. 1 illustrates an example drilling system 100, according to aspects of the various embodiments. The drilling system 100 is used, for example, to drill a wellbore 102 into a subterranean formation 104. The drilling system 100 includes, for example, a drill rig 106 adapted to turn a drilling tool assembly 108 that extends downwards into the wellbore 104. The drilling tool assembly 108 includes, for example, a drill string 110, a bottomhole assembly (BHA) 112, and a bit 114 attached to the downhole end of the drill string 110 and/or BHA 112. As further shown in FIG. 1, the drill string 110 includes several joints of drill pipe 116 placed in the wellbore 104. The segments of drill pipe 116 are connected end-to-end through pipe joints 118.

In operation, the drill string 110 transmits drilling fluid (e.g., mud) through a central bore and transmits rotation power from the drill rig 106 to the BHA 112. The drill pipe 116 provides a hydraulic passage through which the drilling fluid is pumped from the surface. The drilling fluid can discharge through selected-size nozzles, jets, or other orifices in the bit 114 for the purposes of cooling the bit 114, for cutting structures thereon, and/or for lifting cuttings out of the wellbore 102 as the wellbore 102 is being drilled.

The BHA 112 includes, for example, the bit 114 and/or one or more other components. For example, the BHA 112 can include additional and/or other components coupled between and/to the drill string 110 and the bit 114. Some examples of additional and/or other components that can be included in the BHA 112 include drill collars, stabilizers, measurement-while drilling (MWD) tools, logging-while-drilling (LWD) tools, downhole motors, underreamers, section mills, hydraulic disconnects, jars, vibration or dampening tools, and/or one or more other types of components. In some examples, the BHA 112 includes a directional drilling assembly 120 that guides the bit 114 during drilling.

The bit 114 can be implemented using any type of bit suitable for degrading downhole materials. For example, the bit 114 can be a drill bit suitable for drilling the subterranean formation 104. Example types of drill bits used for drilling into subterranean formations include fixed-cutter bits and drag bits. In operation, the bit 114 is guided by the directional drilling assembly 120.

In some examples, the drilling system 100 can include additional drilling components and/or accessories, such as special valves (e.g., kelly cocks, blowout preventers, and safety valves). Moreover, additional components included in the drilling system 100 can be considered a part of the drill rig 106, the drilling tool assembly 108, the drill string 110, and/or the BHA 112 depending on the locations of the additional components in the drilling system 100. As further shown in FIG. 1, the drilling system 100 can include and/or be in electronic communication with a control system 122. As will be described in more detail herein, the control system 122 is adapted to control operation of the drilling system 100. Although illustrated as being located at the surface proximate the drill rig 106, persons skilled in the art should understand that the control system 122 can be positioned in any suitable location. Moreover, in some examples, the control system 122 can include one or more components that are located remotely from the drilling system 100.

Figure 2:
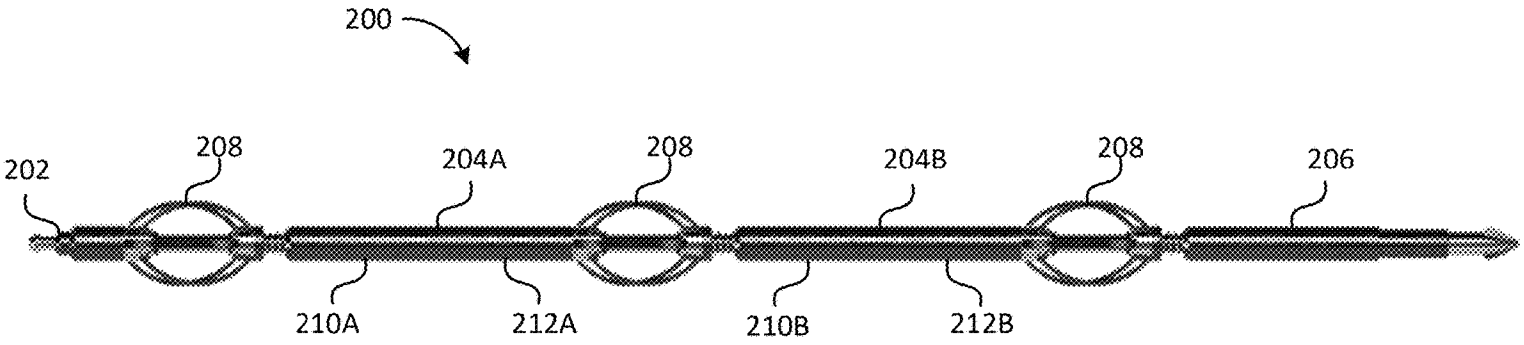
FIG. 2 illustrates an example survey tool that can be used to conduct a wellbore survey, according to various embodiments.

FIG. 2 illustrates an example survey tool 200 that can be used to conduct a wellbore survey, according to various embodiments. For example, the survey tool 200 can be dropped inside the drill pipe 116 and used to survey the wellbore 102 as the survey tool 200 moves through the drill pipe 116. As shown, the survey tool 200 includes a spearpoint 202, a first housing 204A, a second housing 204B, and a decelerator 206 that are interconnected via a plurality of centralizers 208. For example, the spearpoint 202 is connected to the first housing 204A via first centralizer 208, the first housing 204A is connected to the second housing 204B via a second centralizer 208, and the second housing 204C is connected to the decelerator 206 via a third centralizer 208.

The first housing 204A includes and/or houses a first sensor module 210A and a first battery pack 212A. In some examples, the first sensor module 210A includes an accelerometer, such as a 3-axis accelerometer. In some examples, the first sensor module 210A includes a gyroscope, such as a 3-axis gyroscope. In some examples, the first sensor module 210A includes both an accelerometer (e.g., a 3-axis accelerometer) and a gyroscope (e.g., a 3-axis gyroscope). The first battery pack 212A is adapted to provide operational power to the first sensor module 210A and/or one or more other components of the survey tool 200. In some examples, the first sensor module 210A includes a single-axis, axial accelerometer.

In operation, the first sensor module 210A generates measurements that can be used to determine orientation information (e.g., inclination, azimuth, orientation angle, etc.) associated with the survey tool 200 as the survey tool 200 moves through the drill pipe 218 and/or wellbore 102. In addition, as will be described in more detail herein, the first sensor module 210A can generate one or more measurements that can be used to determine depth of the survey tool 200 as the survey tool 200 moves through the drill pipe 218 and/or wellbore 102. For example, an accelerometer included in the first sensor module 210A can generate an axial measurement indicative of the survey tool 200 passing through a pipe joint 118, which can be used to determine depth of the survey tool 200. That is, a measurement signal generated along one axis of the accelerometer (e.g., an axis of the accelerometer that is orthogonal to the other axes used to measure inclination) can be used to detect when the survey tool 200 passes through a pipe joint 118 during movement of the survey tool 200 through the drill pipe 116. With the disclosed techniques, a depth of the survey tool 200 can be determined, or estimated, based in part on a detected time at which the survey tool 200 passes through the pipe joint 118 and known dimensions of the drill pipe 116 and/or the survey tool 200.

The second housing 204B is similar to the first housing 204A. As shown, the second housing 204B includes and/or houses a second sensor module 210B and a second battery pack 212B. In some examples, the second sensor module 210B includes an accelerometer, such as a 3-axis accelerometer. In some examples, the second sensor module 210B includes a gyroscope, such as a 3-axis gyroscope. In some examples, the second sensor module 210B includes both an accelerometer (e.g., a 3-axis accelerometer) and a gyroscope (e.g., a 3-axis gyroscope). In some examples, the second sensor module 210B includes a single-axis, axial accelerometer.

In some examples, the second sensor module 210B includes a different type of sensor than the first sensor module 210A. For example, if the first sensor module 210A includes an accelerometer, the second sensor module 210B includes a gyroscope. As another example, if the first sensor module 210A includes a gyroscope, the second sensor module 210B includes an accelerometer. In some examples, the second sensor module 210B is included in the survey tool 200 for redundancy purposes and includes the same types and/or amount of sensors as the first sensor module 210A. The second battery pack 212B is adapted to provide operational power to the first sensor module 210A and/or one or more other components of the survey tool 200.

Similar to the first sensor module 210A, in operation, the second sensor module 210B generates measurements that can be used to determine orientation information (e.g., inclination, azimuth, orientation angle, etc.) associated with the survey tool 200 as the survey tool 200 moves through the drill pipe 218 and/or wellbore 102. In addition, as will be described in more detail herein, the second sensor module 210B can generate one or more measurements that can be used to determine depth of the survey tool 200 as the survey tool 200 moves through the drill pipe 218 and/or wellbore 102. For example, an accelerometer included in the second sensor module 210B can generate an axial measurement indicative of the survey tool 200 passing through a pipe joint 118, which can be used to determine depth of the survey tool 200. That is, a measurement signal generated along one axis of the accelerometer (e.g., an axis of the accelerometer that is orthogonal to the other axes used to measure inclination) can be used to detect when the survey tool 200 passes through a pipe joint 118 during movement of the survey tool 200 through the drill pipe 116. With the disclosed techniques, a depth of the survey tool 200 can be determined, or estimated, based in part on a detected time at which the survey tool 200 passes through the pipe joint 118 and known dimensions of the drill pipe 116 and/or the survey tool 200.

The centralizers 208 are adapted to maintain, or centralize, the lateral position of the survey tool 200 within the drill pipe 116 as the survey tool 200 moves through the drill pipe 116. For example, the centralizers 208 are adapted to contact the inner surfaces of the drill pipe 116, thereby maintaining and/or centralizing the lateral position of the survey tool 200 within the drill pipe 116 as the survey tool 200 moves through the drill pipe 116. As shown in the illustrated example of FIG. 2, the centralizers 208 are wider and/or have a greater circumference than the other components of the survey tool 200.

In the illustrated example of FIG. 2, the survey tool 200 includes two housings 204A, 204B and three centralizers 208. However, in other examples, a survey tool can include a different number of housings 204 and/or a different number of centralizers 208. For example, some survey tools only include a single housing 204 and/or only include two centralizers 208. In some examples, a survey tool can include more than two housings 204 and/or more than two centralizers 208. Moreover, in some examples, an individual housing 204 can include additional sensor arrays and/or individual sensors (e.g., pressure sensors, temperature sensors, etc.) not explicitly described herein.

Figure 3:
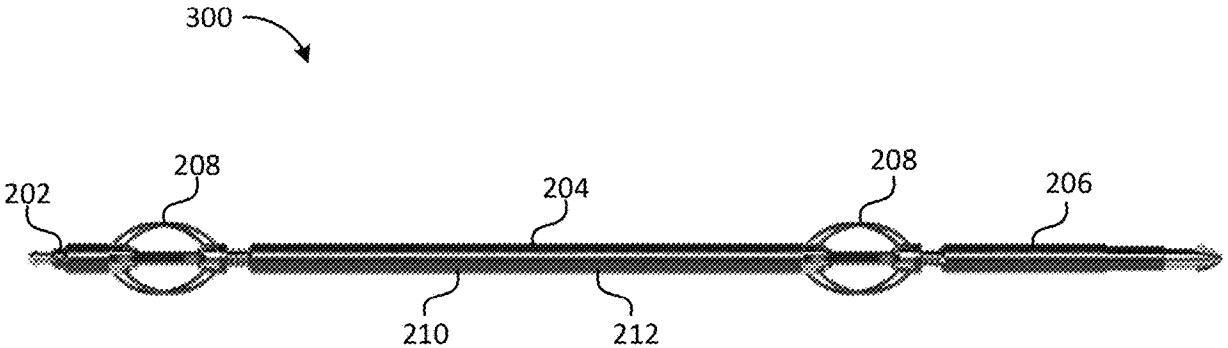
FIG. 3 illustrates another example survey tool that can be used to conduct a wellbore survey, according to various embodiments.

FIG. 3 illustrates another example survey tool 300 that can be used to conduct a wellbore survey, according to various embodiments. The survey tool 300 is similar in operation and construction to the survey tool 200. However, as shown, the survey tool 300 only includes a single housing 204 and two centralizers 208. For example, the survey tool 300 includes a spearpoint 202 that is connected to the housing 204 via a first centralizer 208 and a decelerator 206 that is connected to the housing 204 via a second centralizer 208. The housing 204 included in the survey tool 300 can be, for example, similar in construction and operation to the housings 204A, 204B described herein with respect to the survey tool 200. For example, the housing 204 includes a sensor module 210 and a battery pack 212.

Persons skilled in the art should understand that the survey tools 200, 300 are just two non-limiting examples of survey tools that could be used to implement the techniques described herein. Moreover, persons skilled in the art should understand that other types of survey tools not explicitly shown or described herein can be adapted to implement one or more of the techniques described herein with respect to the survey tool 200 and/or the survey tool 300. Furthermore, persons skilled in the art should understand that, in some examples, functionality described herein with respect to the survey tool 200 can also be performed by the survey tool 300. In that regard, for the sake of explanation, the following examples and/or techniques will be primarily described with respect to the survey tool 200. However, it should be understood that the examples and/or techniques described herein can also be implemented using the survey tool 300.

Figure 4:
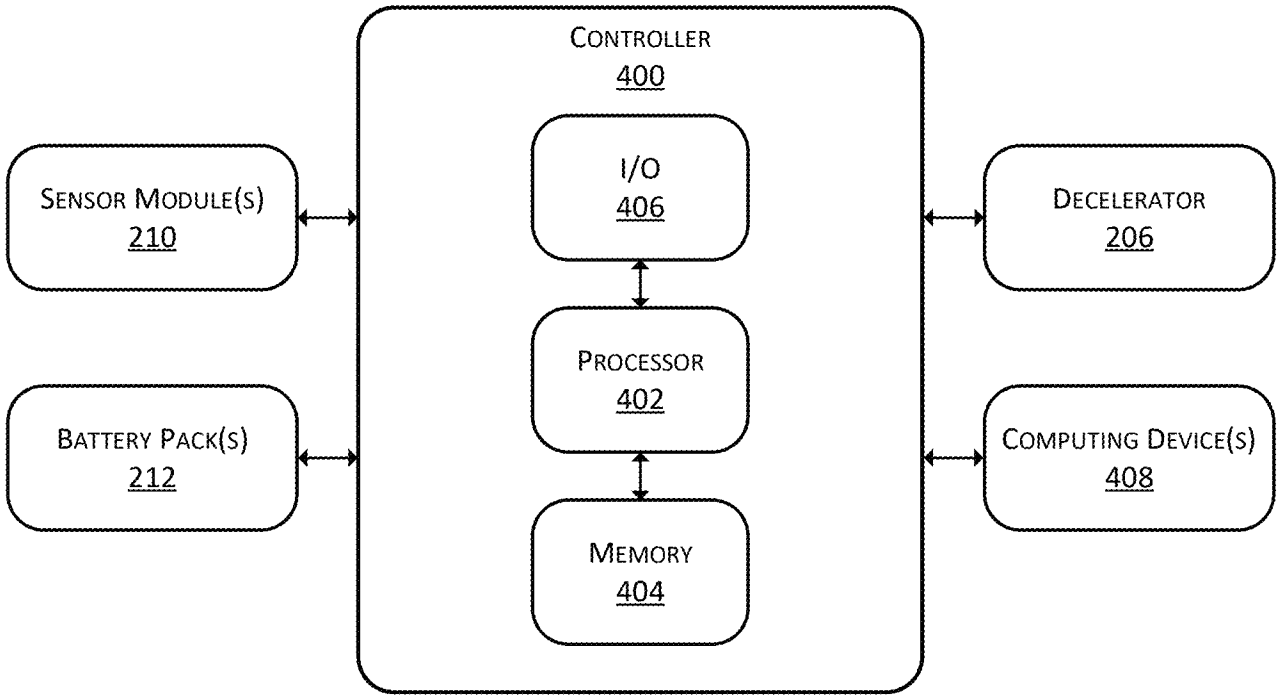
FIG. 4 is a block diagram of an example controller included in a survey tool, according to various embodiments.

FIG. 4 is a block diagram of an example controller 400 included in a survey tool, according to various embodiments. For example, the controller 400 can be included in the survey tool 200, the survey tool 300, and/or in some other type of survey tool not explicitly described herein. Hereinafter, the controller 400 will be described with respect to the survey tool 200. In some examples, the controller 400 is housed within one of the housings 204A, 204B of the survey tool 200.

As shown in the illustrated example of FIG. 4, the controller 400 is coupled to and/or controls operation of various components included in the survey tool 200. For example, the controller 400 is coupled to the decelerator 206, the first and/or second sensor modules 210A, 210B, and the first and/or second battery packs 212A, 212B. As further shown in the illustrated example of FIG. 4, the controller 400 includes a processor 402 (e.g., a microprocessor, a microcontroller, or another suitable programmable device), a memory 404, and an input/output ("I/O") system 406 that are interconnected by a bus. In some examples, the controller 400 can be implemented as a computing device such as, but not limited to, a special purpose computing device, a general purpose computing device, or some other suitable type of computing device.

The I/O system 406 includes routines for transferring information between components within the controller 400 and other components of the survey tool 200. In some examples, the I/O system 406 includes a communication interface that is configured to provide communication between the controller 400 and one or more external computing devices 408. In some examples, the I/O system 406 enables the controller 400 to communicate with a computing device 408 included in the control system 122 for the drilling system 100.

In some examples, the controller communicates with the one or more computing devices 408 through a wired connection (e.g., a USB connection). In some examples, the controller 400 communicates with the one or more computing devices 408 with a local wireless connection.

In some examples, the controller 400 communicates with the one or more computing devices 408 through a network. The network is, for example, a wide area network (WAN) (e.g., the Internet, a TCP/IP based network, a cellular network, such as, for example, a Global System for Mobile Communications [GSM] network, a General Packet Radio Services [GPRS] network, a Code Division Multiple Access [CDMA] network, an Evolution-Data Optimized [EV-DO] network, an Enhanced Data Rates for GSM Evolution [EDGE] network, a 3 GSM network, a 4GSM network, a Digital Enhanced Cordless Telecommunications [DECT] network, a Digital AMPS [IS-136/TDMA] network, or an Integrated Digital Enhanced Network [iDEN] network, etc.). In other examples, the network is, for example, a local area network (LAN), a neighborhood area network (NAN), a home area network (HAN), or personal area network (PAN) employing any of a variety of communications protocols, such as Wi-Fi, Bluetooth, ZigBee, etc. In some examples, the network includes one or more of a wide area network (WAN), a local area network (LAN), a neighborhood area network (NAN), a home area network (HAN), or personal area network (PAN). In some examples, the controller 400 communicates with the one or more computing devices 408 through a wired connection.

The memory 404 includes, for example, a read-only memory ("ROM"), a random access memory ("RAM"), an electrically erasable programmable read-only memory ("EEPROM"), a flash memory, a hard disk, an SD card, or another suitable magnetic, optical, physical, or electronic memory device. The memory 404 stores software, such as but not limited to firmware, one or more applications, program data, one or more program modules, and/or other executable instructions, for surveying a wellbore 102. In some examples, the memory 404 stores one or more operating modes, such as a continuous mode and/or a gyrocompass mode, for the survey tool 200. In some examples, the memory 404 stores measurements generated by survey tool 200 as the survey tool 200 is used to survey the wellbore 102. For example, memory 404 stores measurements generated by the accelerometer(s) and/or gyroscope(s) included in the sensor modules 210A, 210B as the survey tool 200 moves through the drill pipe 116.

In operation, the processor 402 retrieves from the memory 404 and executes software instructions for surveying a wellbore 102. Hereinafter, functions and/or actions performed by components of the controller 400 (e.g., processor 402, memory 404, and I/O system 406) can collectively be referred to as being performed by the controller 400. In that regard, the controller 400 executes software instructions for surveying a wellbore 102. For example, the controller 400 controls the first and/or second sensor modules 210A, 210B to generate measurements indicative of the inclination and/or azimuth of the survey tool 200 as the survey tool 200 moves through drill pipe 116 placed in a wellbore 102. As another example, the controller 400 controls the first and/or second sensor modules 210A, 210B to generate axial accelerometer measurements that can be used to determine a depth of the survey tool 200 as the survey tool 200 moves through the drill pipe 116.

In some examples, the accelerometers and/or gyroscopes included in the sensor modules 210A, 210B continuously and/or periodically generate measurements. For example, the accelerometers and/or gyroscopes included in the sensor modules 210A, 210B can continuously and/or periodically generate measurements at a rate of, for example, 25 Hz. In some examples, the accelerometers and/or gyroscopes included in the sensor modules 210A, 210B can continuously and/or periodically generate measurements at a different rate (e.g., 10 Hz, 45 Hz, 60 Hz, etc.). In some examples, the accelerometers and/or gyroscopes included in the sensor modules 210A, 210B can generate measurements intermittently and/or on an ad-hoc basis.

The controller 400 stores the measurements generated by the first and/or second sensor modules 210A, 210B in the memory 404. As will be described in more detail herein, the measurements stored in the memory 404 can later be used to determine a continuous azimuth and/or inclination of the survey tool 200 moving through the drill pipe 116. Moreover, the axial accelerometer measurements stored in the memory 404 can later be used to determine the depth of the survey tool 200 moving through the drill pipe 116. In some examples, the controller 400 can transmit (e.g., wirelessly via the I/O system 406) measurements generated by the first and/or second sensor modules 210A, 210B as the survey tool 200 moves through the drill pipe 116.

In some examples, the controller 400 determines, based on the measurements stored in the memory 404, (i) the continuous azimuth and/or inclination of the survey tool 200 moving through the drill pipe 116 and/or (ii) the depth of the survey tool moving through the drill pipe 116. In some examples, the controller 400 can also determine a trajectory of the wellbore 102 based in part on the (i) the continuous azimuth and/or inclination of the survey tool 200 moving through the drill pipe 116 and/or (ii) the depth of the survey tool moving through the drill pipe 116. In such examples, the controller 400 can map, or assign, determined depths of the survey tool 200 to the determined continuous azimuth and/or inclination of the survey tool 200 moving through the drill pipe 116.

In some examples, a computing device 408 included in the control system 122 can determine, based on the measurements generated by the survey tool 200 and/or stored in the memory 404 of the survey tool 200, (i) the continuous azimuth and/or inclination of the survey tool 200 moving through the drill pipe 116 and/or (ii) the depth of the survey tool moving through the drill pipe 116. In such examples, the controller 400 can provide (e.g., via the I/O system 406) the measurements stored in the memory 404 to the computing device 408 included in the control system 122. Furthermore, in some examples, the computing device 408 included in the control system 122 can also determine a trajectory of the wellbore 102 based in part on the (i) the continuous azimuth and/or inclination of the survey tool 200 moving through the drill pipe 116 and/or (ii) the depth of the survey tool 200 moving through the drill pipe 116. In such examples, the computing device 408 can map, or assign, determined depths of the survey tool 200 to the determined continuous azimuth and/or inclination of the survey tool 200 moving through the drill pipe 116.

FIGS. 5A-5G illustrate an example in which a survey tool 200 is used to survey a wellbore 102, according to various embodiments. In the illustrated examples of FIGS. 5A-5G, the survey tool 200 is dropped inside and moves through the drill pipe 116 to survey the wellbore 102. As the survey tool 200 moves through the drill pipe 116, the first and/or second sensor modules 210A, 210B generate measurements that can be used to determine orientation information, such as a continuous azimuth and/or inclination, of the survey tool 200 moving through the drill pipe 116. Also, as will described in more detail herein, an axial accelerometer included in the first and/or second sensor modules 210A, 210B generates measurements that can be used to determine the depth of the survey tool 200 moving through the drill pipe 116. Any measurements generated by the first and/or second modules 210A, 210B as the survey tool 200 moves through the drill pipe 116 can be stored in the memory 404 for later use.

Figure 5A:
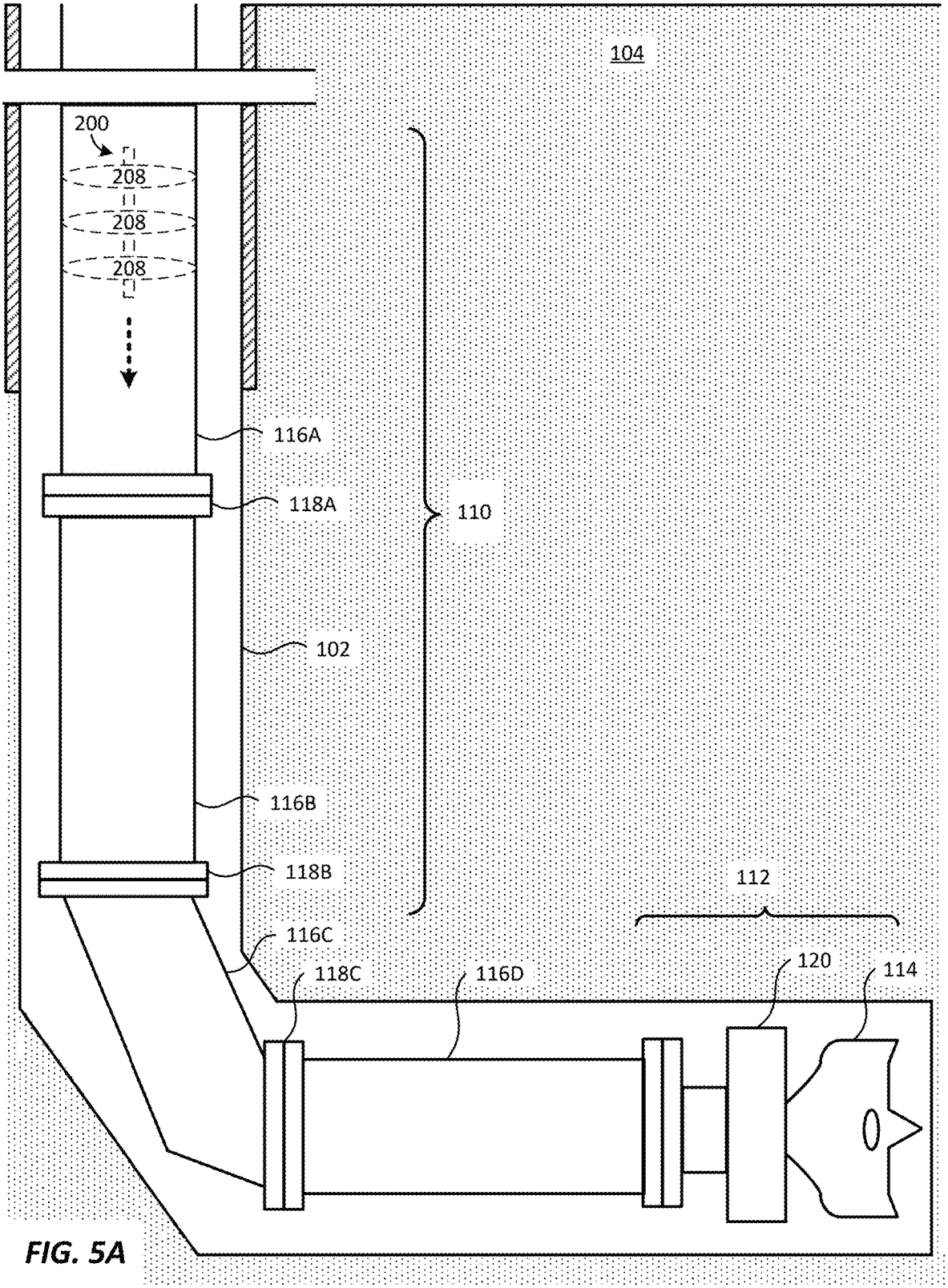
FIGS. 5A-5G illustrate an example in which a survey tool moves through a drill pipe placed in a wellbore, according to various embodiments.

With reference to FIG. 5A, after the survey tool 200 is dropped from the surface inside the drill pipe 116, the survey tool 200 enters and moves downward through a first segment of drill pipe 116A. As the survey tool 200 moves through the first segment of drill pipe 116A, the centralizers 208 touch, or make contact with, the inner walls of the first segment of drill pipe 116A. As described herein, the centralizers 208 help locate, or centralize, the survey tool 200 laterally within the interior of the first segment of drill pipe 116A.

Figure 5B:
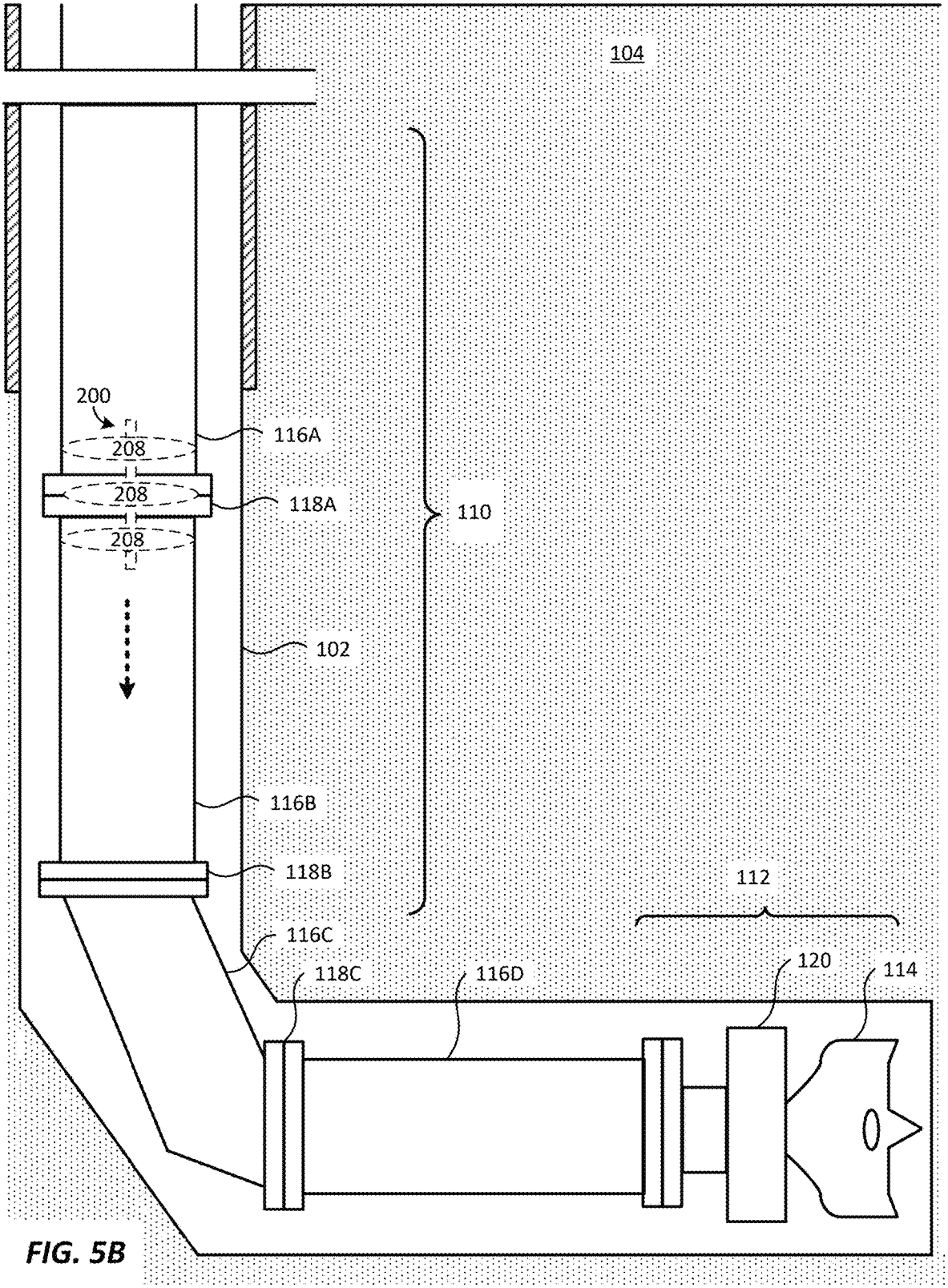
Figure 5C:
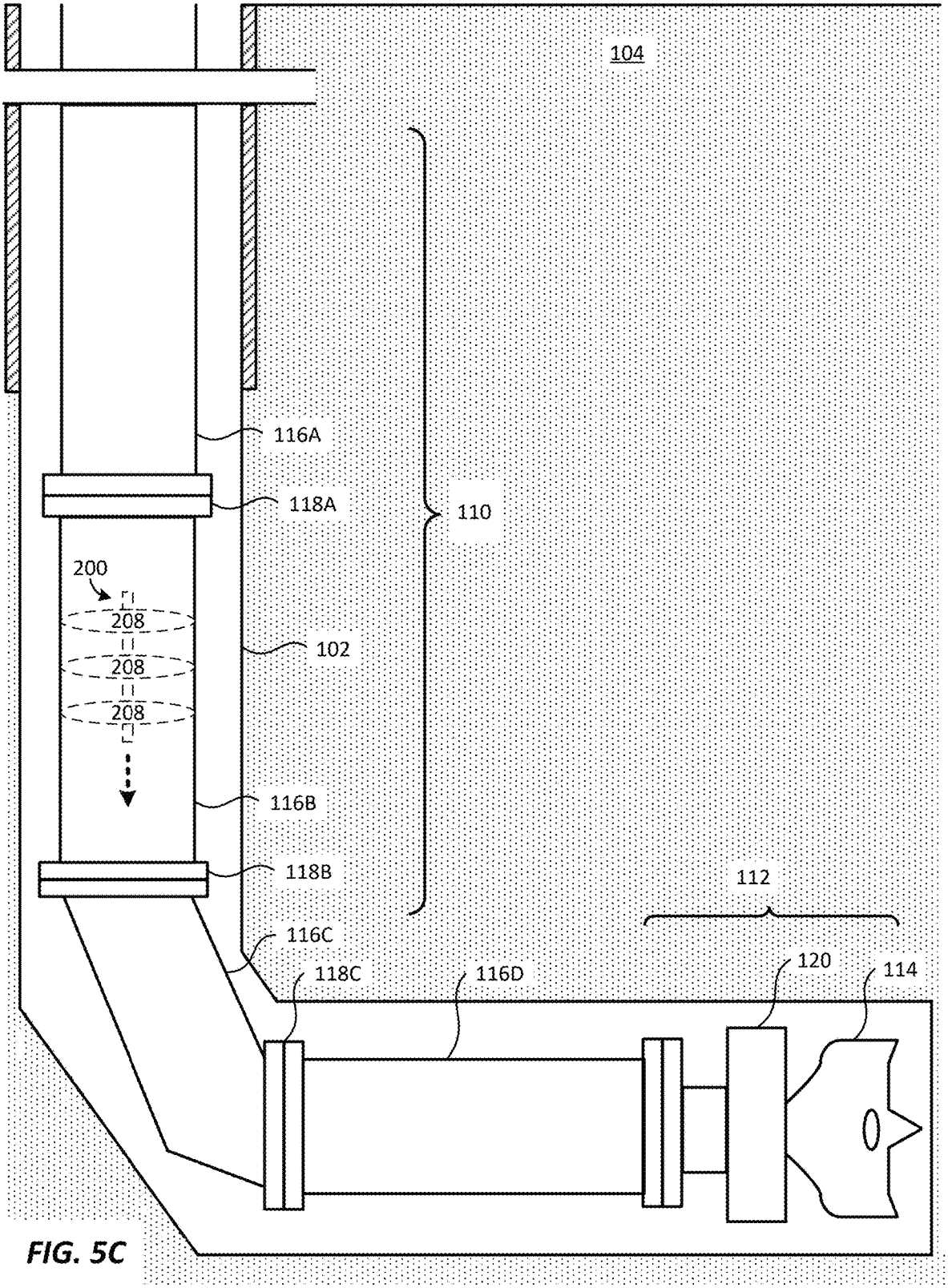
Figure 5D:
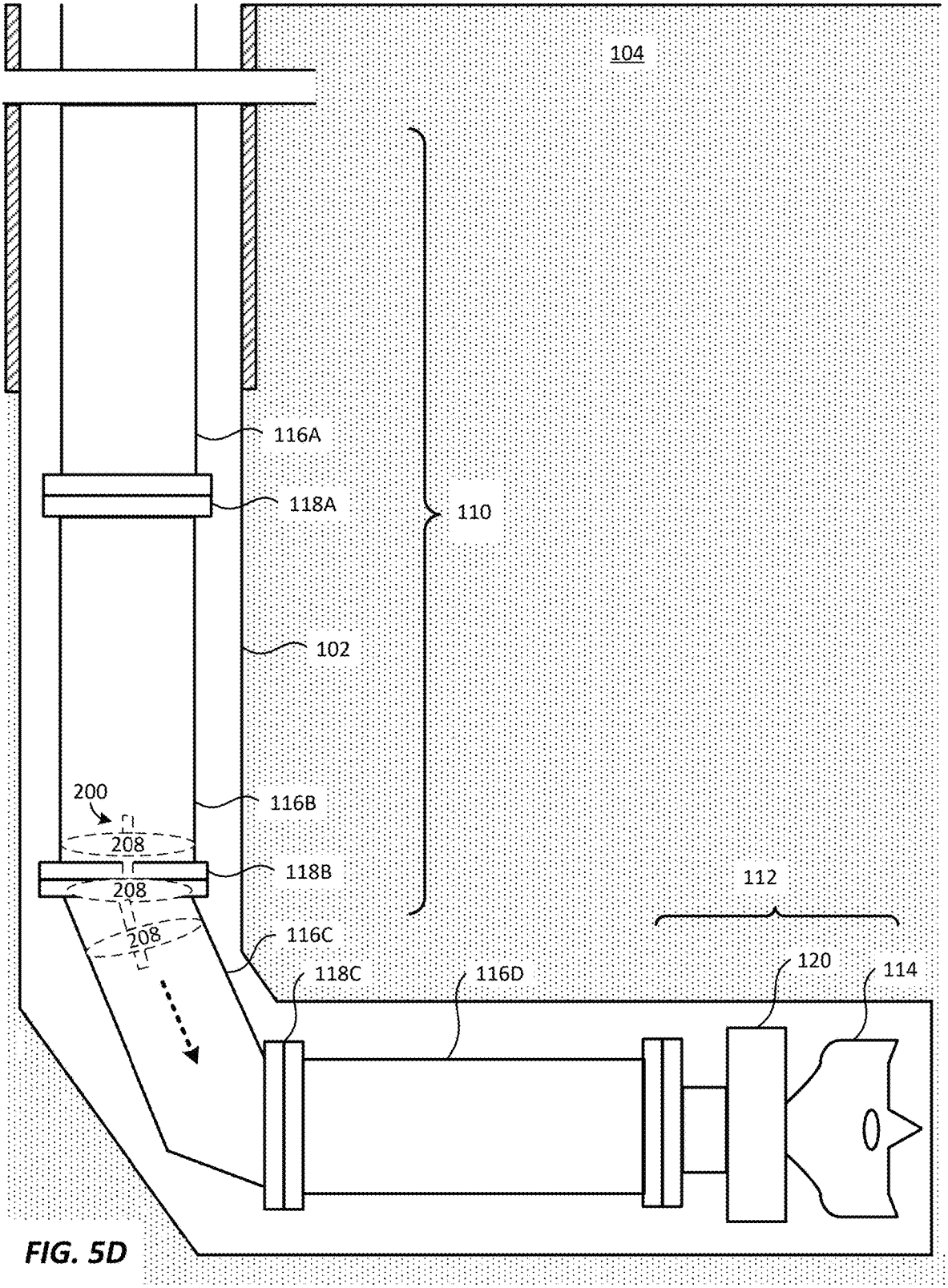
Figure 5E:
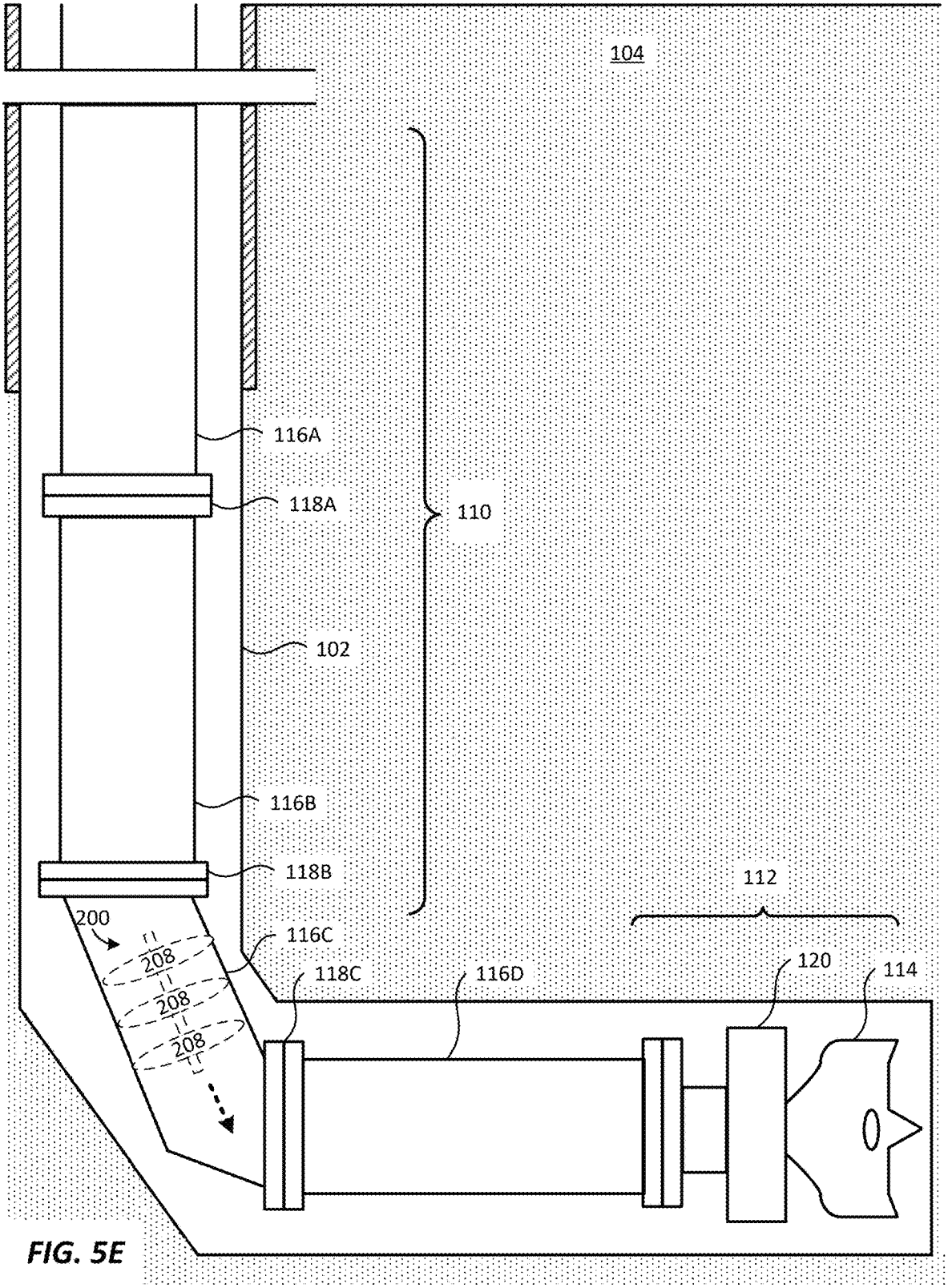
Figure 5F:
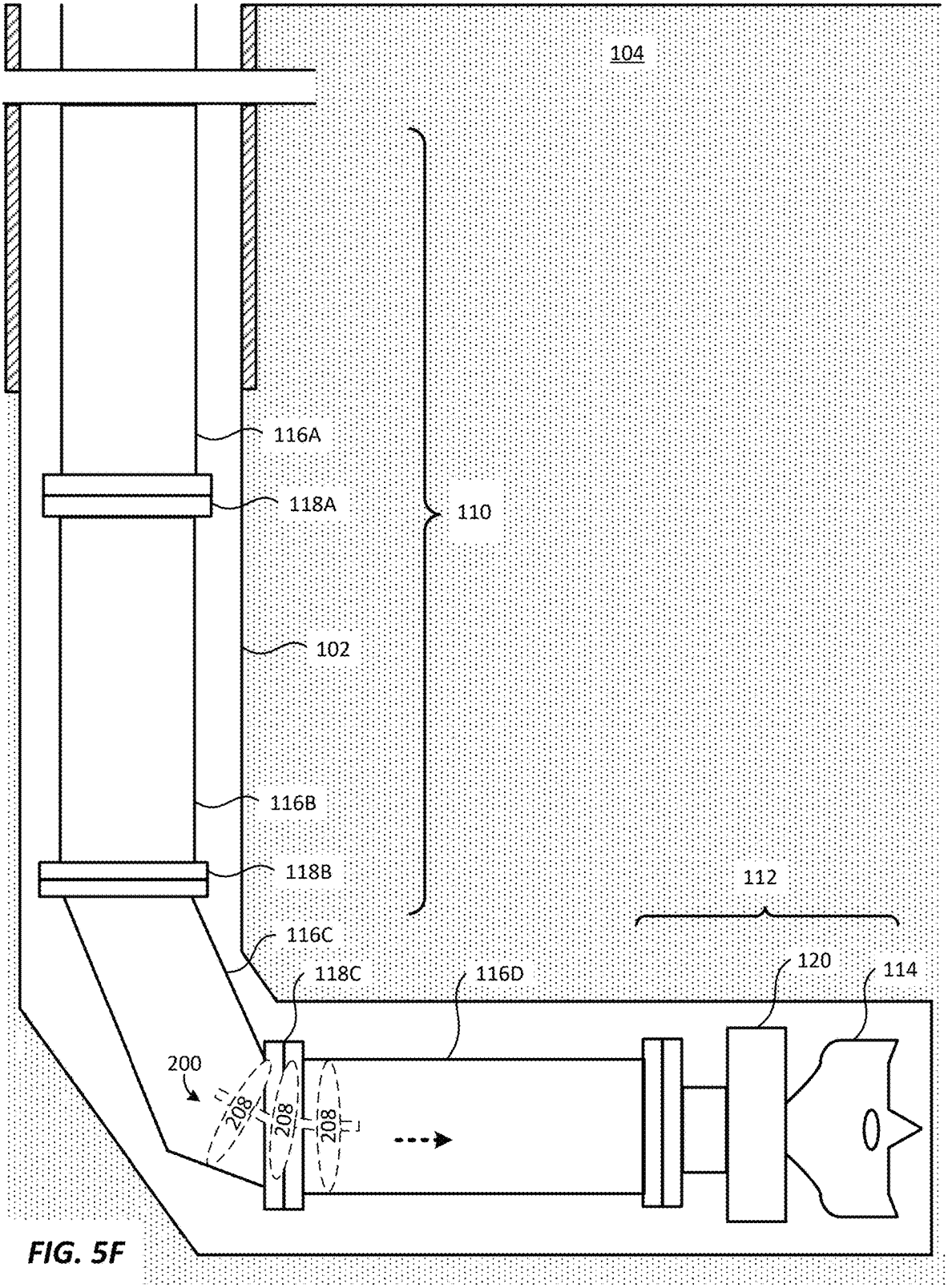
Figure 5G:
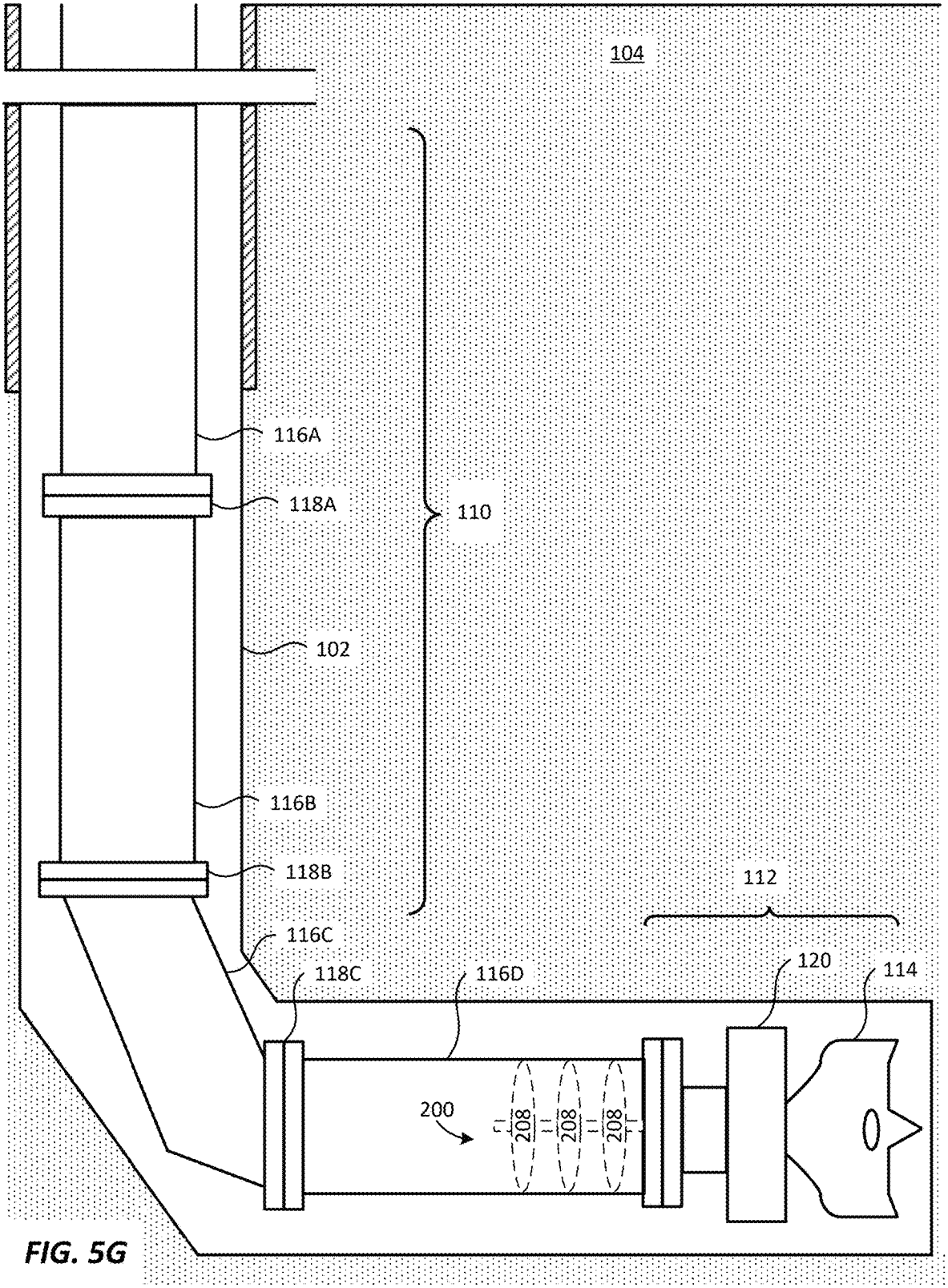

Then, as shown in FIG. 5B, the survey tool 200 exits the first segment of drill pipe 116A via a pipe joint 118A. However, the pipe joint 118A is not uniform with the interior of the segment of drill pipe 116A. Therefore, as a centralizer 208 passes through the pipe joint 118A, the survey tool 200 experiences a disturbance, such as a bump or a perturbation. As described herein, an axial accelerometer included in the first and/or second sensor module 210A, 210B can sense this disturbance, which appears as a spike in the measurement signal generated by the axial accelerometer. In some examples, the axial accelerometer is a standalone accelerometer. In other examples, the axial accelerometer is one of the three accelerometer sensors included in a 3-axis accelerometer.

For examples in which the survey tool 200 includes three centralizers 208, such as in the illustrated examples of FIGS. 5A-5G, the axial accelerometer senses a respective disturbance caused by each of the three centralizers 208 moving through the pipe joint 118A. That is, the axial accelerometer senses a first disturbance as the first centralizer 208 moves through the pipe joint 118A, senses a second disturbance as the second centralizer 208 moves through the pipe joint 118A, and senses a third disturbance as the third centralizer 208 moves through the pipe joint 118A. These disturbances are represented, or appear, as consecutive spikes in the measurement signal generated by the axial accelerometer. For example, the measurement signal generated by the axial accelerometer includes a first spike that corresponds to movement of the first centralizer 208 through the pipe joint 118A, a second spike that corresponds to movement of the second centralizer 208 through the pipe joint 118A, and a third spike that corresponds to movement of the third centralizer 208 through the pipe joint 118A.

As shown in FIGS. 5C-5G, the survey tool 200 continues to move through the segments of drill pipe 116 and pipe joints 118 until the survey tool 200 reaches the BHA 112. For example, after exiting the first segment of drill pipe 116A via the pipe joint 118A, the survey tool 200 enters and moves through a second segment of drill pipe 116B (see FIG. 5C). The survey tool 200 then exits the second segment of drill pipe 116B via a pipe joint 118B (see FIG. 5D) and enters a third segment of drill pipe 116C (see FIG. 5E). Similar to the movement of the survey tool 200 through the pipe joint 118A, the survey tool 200 experiences disturbances, such as bumps or perturbations, when the centralizers 208 of the survey tool 200 move through the pipe joint 118B. These disturbances can be sensed by the axial accelerometer included in the first and/or second sensor modules 210A, 210B and are represented, or appear, as consecutive spikes in the measurement signal generated by the axial accelerometer.

After moving through the third segment of drill pipe 116C, the survey tool 200 exits the third segment of drill pipe 116C via the pipe joint 118C (see FIG. 5F) and enters a fourth segment of drill pipe 116D. Similar to the movement of the survey tool 200 through the pipe joints 118A and 118B, the survey tool 200 experiences disturbances, such as bumps or perturbations, when the centralizers 208 of the survey tool 200 move through the pipe joint 118C. These disturbances can be sensed by the axial accelerometer included in the first and/or second sensor modules 210A, 210B and represented, or appear, as consecutive spikes in the measurement signal generated by the axial accelerometer. Movement of the survey tool 200 stops once the survey tool 200 reaches the BHA 112 (see FIG. 5G). The survey tool 200 remains positioned on and/or against the BHA 112 until the survey tool 200 is returned to the surface.

Figure 6:
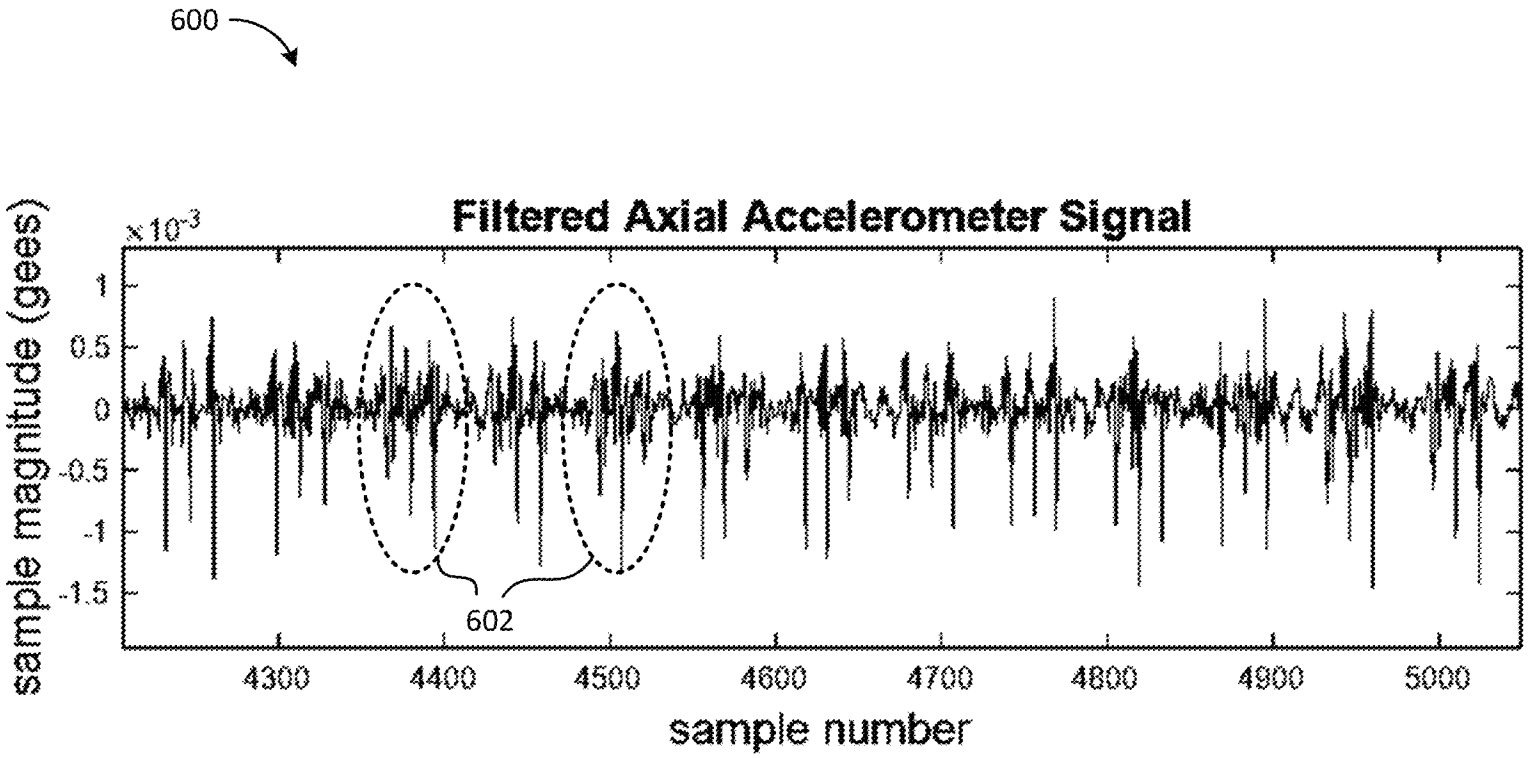
FIG. 6 illustrates an example measurement signal generated by an axial accelerometer as a survey tool moves through a drill pipe placed in a wellbore, according to various embodiments.

FIG. 6 illustrates an example measurement signal 600 generated by an axial accelerometer as a survey tool moves through a drill pipe placed in a wellbore, according to various embodiments. For example, an axial accelerometer included in the first and/or second sensor modules 210A, 210B of survey tool 200 generates the measurement signal 600 as the survey tool 200 moves through the drill pipe 116 placed in the wellbore 102.

As shown in FIG. 6, the measurement signal 600 includes spike groups 602 that correspond to passage of the survey tool 200 through a pipe joint 118. For example, because the survey tool 200 has three centralizers 208, each spike group 602 in the measurement signal 600 includes three spikes, with each of the three spikes corresponding to a disturbance caused by movement of a respective one of the three centralizers 208 through a pipe joint 118. For example, a first spike in a spike group 602 corresponds to the acceleration change (e.g., disturbance) resulting from movement of a first centralizer 208 through a pipe joint 118, a second spike in a spike group 602 corresponds to the acceleration change (e.g., disturbance) resulting from movement of a second centralizer 208 through a pipe joint 118, and a third spike in a spike group 602 corresponds to the acceleration change (e.g., disturbance) resulting from movement of a third centralizer 208 through a pipe joint 118. For examples in which a survey tool has more or fewer than three centralizers (e.g., survey tool 300), the number of consecutive spikes per spikes grouping in a measurement signal will correspond to the number of centralizers 208 in the survey too 200. As used herein, the term "spike" refers to a spike, or a rapid and a significant change, in the amplitude of the measurement signal 600.

The spike groups 602 appearing in the measurement signal 600 are adequately spaced from each other, and thus easily detected, due to the dimensions and/or geometries of the survey tool 200 and the drill pipe segments 116 relative to each other. For example, the distance between the first and third centralizers 208 (e.g., 10-15 feet) on the survey tool 200 is designed to be significantly less than the length of the segments of drill pipe 116 (e.g., 30-50 feet). In that regard, there is ample spacing between the times at which the survey tool 200 passes through consecutive pipe joints 118 (e.g., pipe joints 118A and 118B), thereby providing ample spacing in the measurement signal 600 between spike groups 602.

As will be described in more detail herein, by detecting spike groups 602 in a measurement signal 600 generated by the axial accelerometer, the times at which the survey tool 200 passes through respective pipe joints 118 can be determined. Then, with the disclosed techniques, the depth of the survey tool 200 moving through the drill pipe 116 can be estimated based in part on the time(s) at which the survey tool 200 passes through pipe joints 118, known dimensions of the survey tool 200, and/or known dimensions of the segments of drill pipe 116 and/or pipe joints 118. Moreover, with the disclosed techniques, the trajectory of the wellbore 102 can be determined in part by mapping the estimated depths of the survey tool 200 moving through the drill pipe 116 to the orientation information (e.g., continuous azimuth and/or inclination, orientation angles, etc.) of the survey tool 200 that was determined based on the other measurements generated by the first and/or second sensor modules 210A, 210B during movement of the survey tool 200 through the drill pipe 116.

FIGS. 7A-7G illustrate an example in which a survey tool 200 is removed from a wellbore 102, according to various embodiments. For example, the survey tool 200 is removed from the wellbore 102 as the drill string 110 is removed from the wellbore 102 and segments of drill pipe 116 are disconnected from the drill string 110. In some examples, during removal of the survey tool 200 from the wellbore 102, the survey tool 200 can be operated in a "gyrocompass" mode in which the gyroscope sensor(s) included in the first and/or second sensor modules 210A, 210B in which the survey tool 200 acquire gyrocompass survey data. For example, when a segment of drill pipe 116 is removed from the wellbore 102 and disconnected from the drill string 110, the survey tool 200 can remain stationary long enough to acquire gyrocompass survey data that can be used to determine a trajectory of the wellbore 102. Gyrocompass survey data generated during removal of the survey tool 200 from the wellbore 102 can be stored in the memory 404 for later use.

In some examples, during removal of the survey tool 200 from the wellbore 102, the survey tool 200 can be operated in a "continuous" mode in which the first and/or second sensor modules 210A, 210B generate measurements that can be used to determine orientation information, such as a continuous azimuth and/or inclination, of the survey tool 200 moving through the drill pipe 116. Moreover, in some examples, an axial accelerometer included in the first and/or second sensor modules 210A, 210B generates measurements that can be used to determine the depth of the survey tool 200 moving through the drill pipe 116 during removal of the survey tool 200 from the wellbore 102. In some examples, no measurements are generated by the first and/or second sensor modules 210A, 210B during removal of the survey tool 200 from the wellbore 102.

Figure 7A:
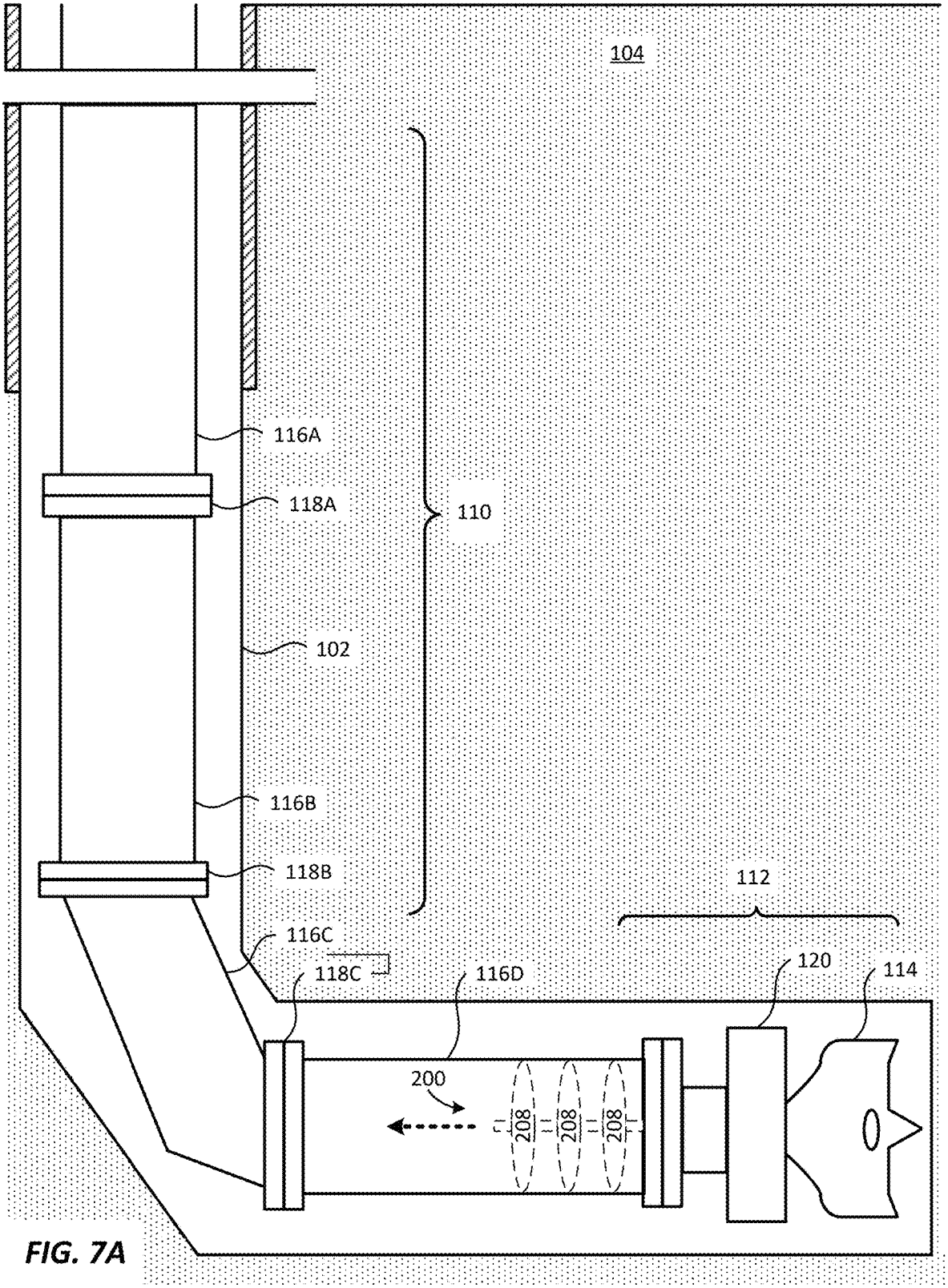
FIGS. 7A-7D illustrate an example in which a survey tool is removed from a wellbore, according to various embodiments.
Figure 7B:
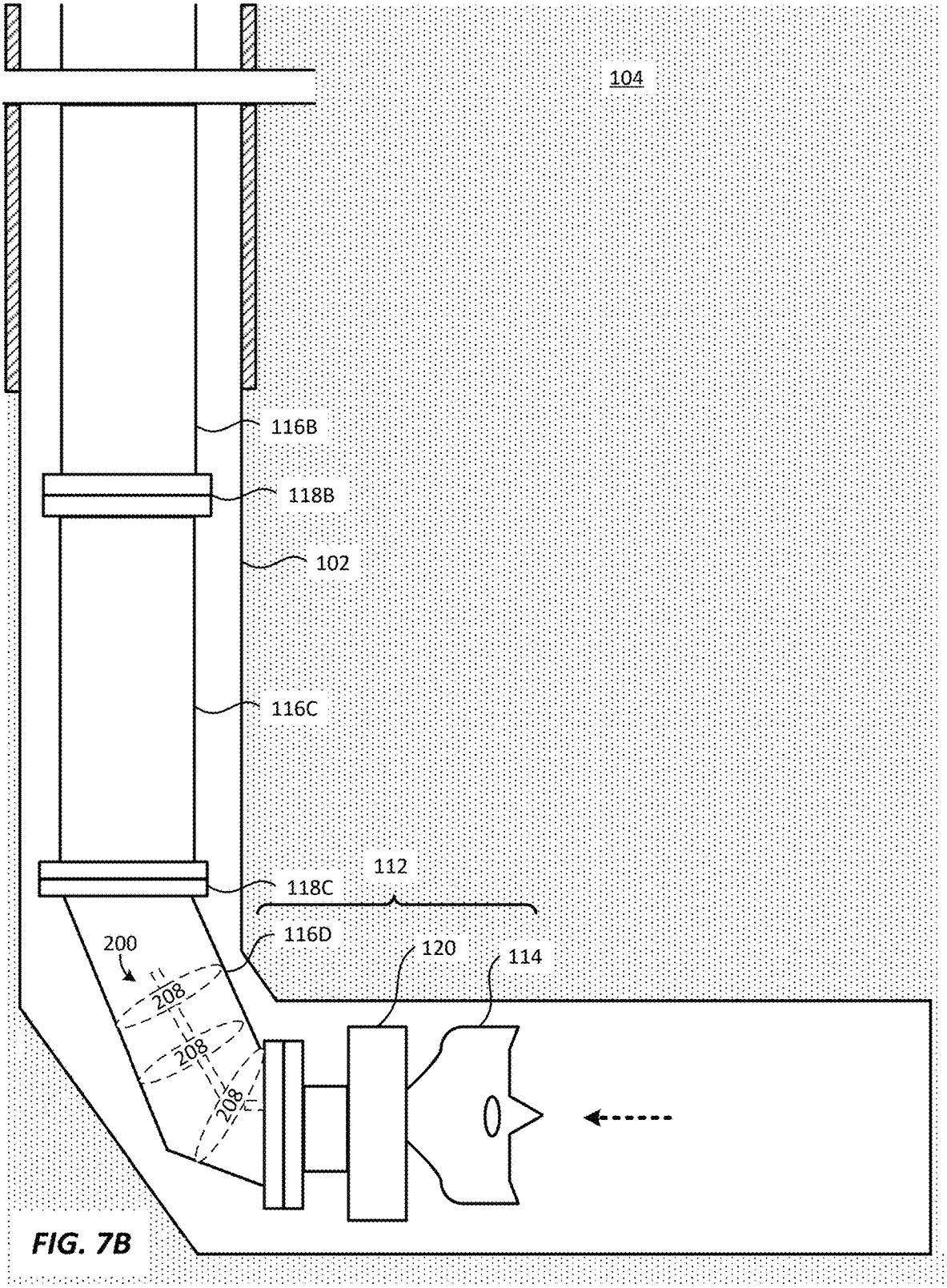

With reference to FIG. 7A, the survey tool 200 rests on and/or against the BHA 112 before any segments of drill pipe 116 are disconnected from the drill string 110. As the drill string 110 is pulled out of the wellbore 102 and segments of drill pipe 116 are removed from the drill string 110, the survey tool 200 is pulled upward through the wellbore along with the BHA 112. For example, as shown in FIG. 7B, the survey tool 200 advances through the wellbore 102 alongside the BHA 112 when the first segment of drill pipe 116A is removed from the wellbore 102 and disconnected from the drill string 110. While the first segment of drill pipe 116A is being disconnected form the drill string 110 at the surface, the survey tool 200 remains stationary for a long enough period of time to generate gyrocompass survey data.

Figure 7C:
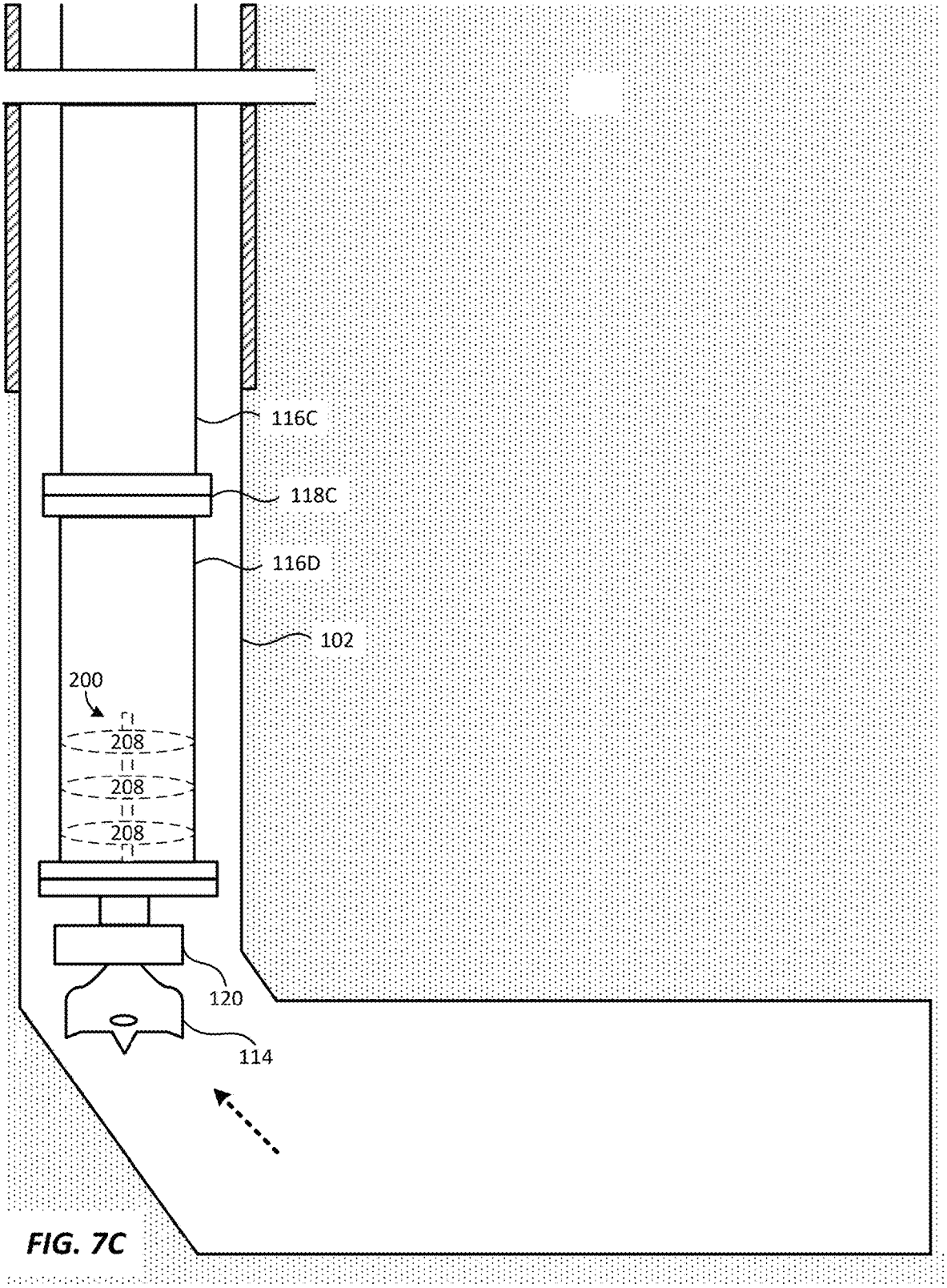
Figure 7D:
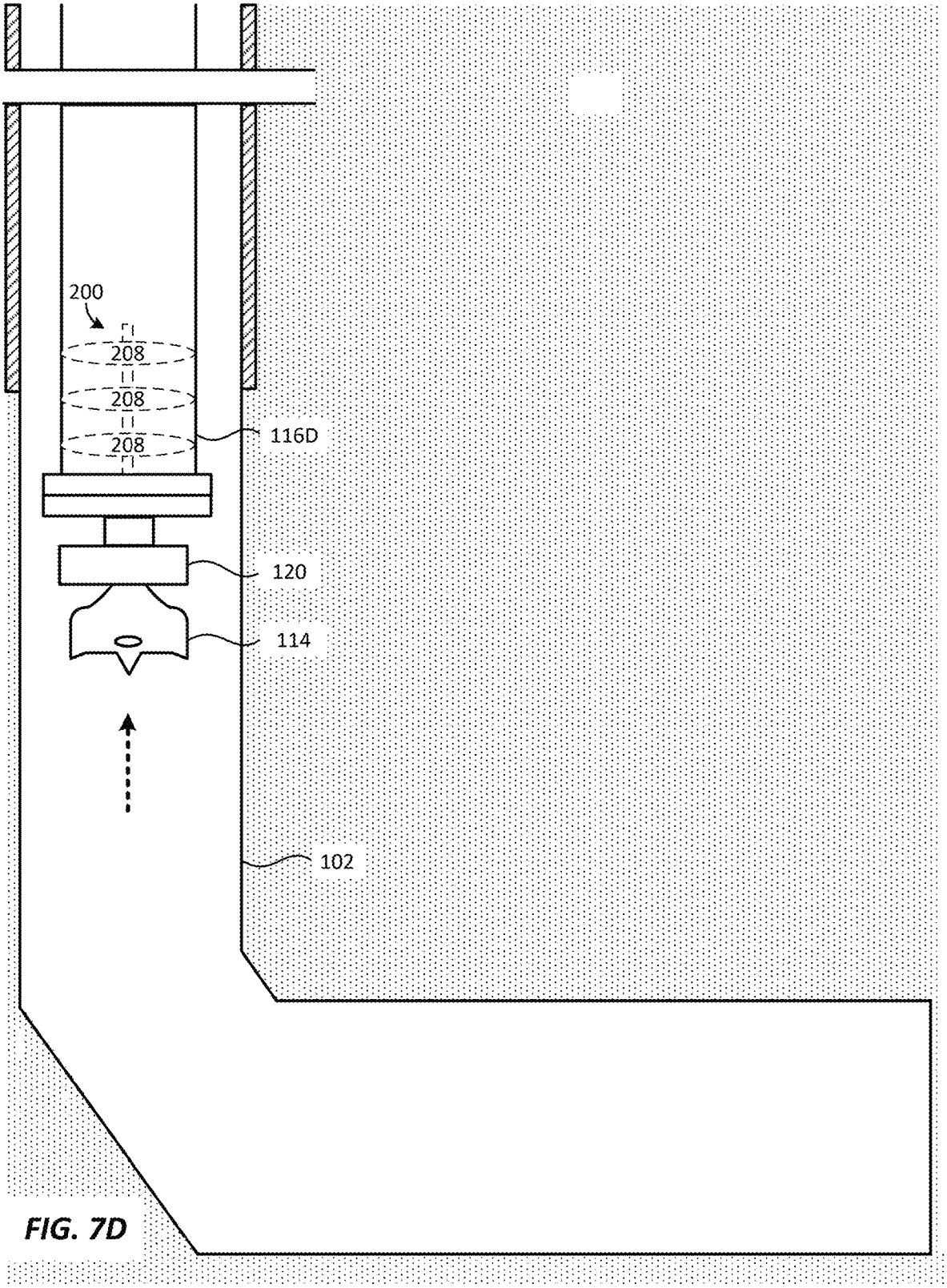

As shown in FIGS. 7C and 7D, the survey tool 200 continues to advance through the wellbore 102 towards the surface as segments of drill pipe 116B, 116C are removed from the wellbore 102 and disconnected from the drill string 110. With respect to FIG. 7C, the survey tool 200 generates gyrocompass survey data as the second segment of drill pipe 116B is removed from the wellbore 102 and disconnected from the drill string 110. Likewise, with respect to FIG. 7D, the survey tool 200 generates gyrocompass survey data as the third segment of drill pipe 116C is removed from the wellbore 102 and disconnected from the drill string 110. Although not shown in the illustrated examples of FIGS. 7A-7D, the survey tool 200 is eventually removed from the wellbore 102 and the segment of drill pipe 116D at the surface.

Upon removal of the survey tool 200 from the wellbore 102 and the segment of drill pipe 116D, the measurements generated by the survey tool 200 and stored in memory 404 can be retrieved (e.g., by a computing device 408 in the control system 122) and used to determine one or more of (i) orientation information such as continuous azimuth and/or inclination of the survey tool 200 moving through the drill pipe 116, (ii) depth(s) of the survey tool 200 moving through the drill pipe 116, and/or (iii) a trajectory of the wellbore 102. The computing device 408 can receive the measurements from the survey tool 200, for example, via a wired connection and/or a wireless network connection.

Figure 8:
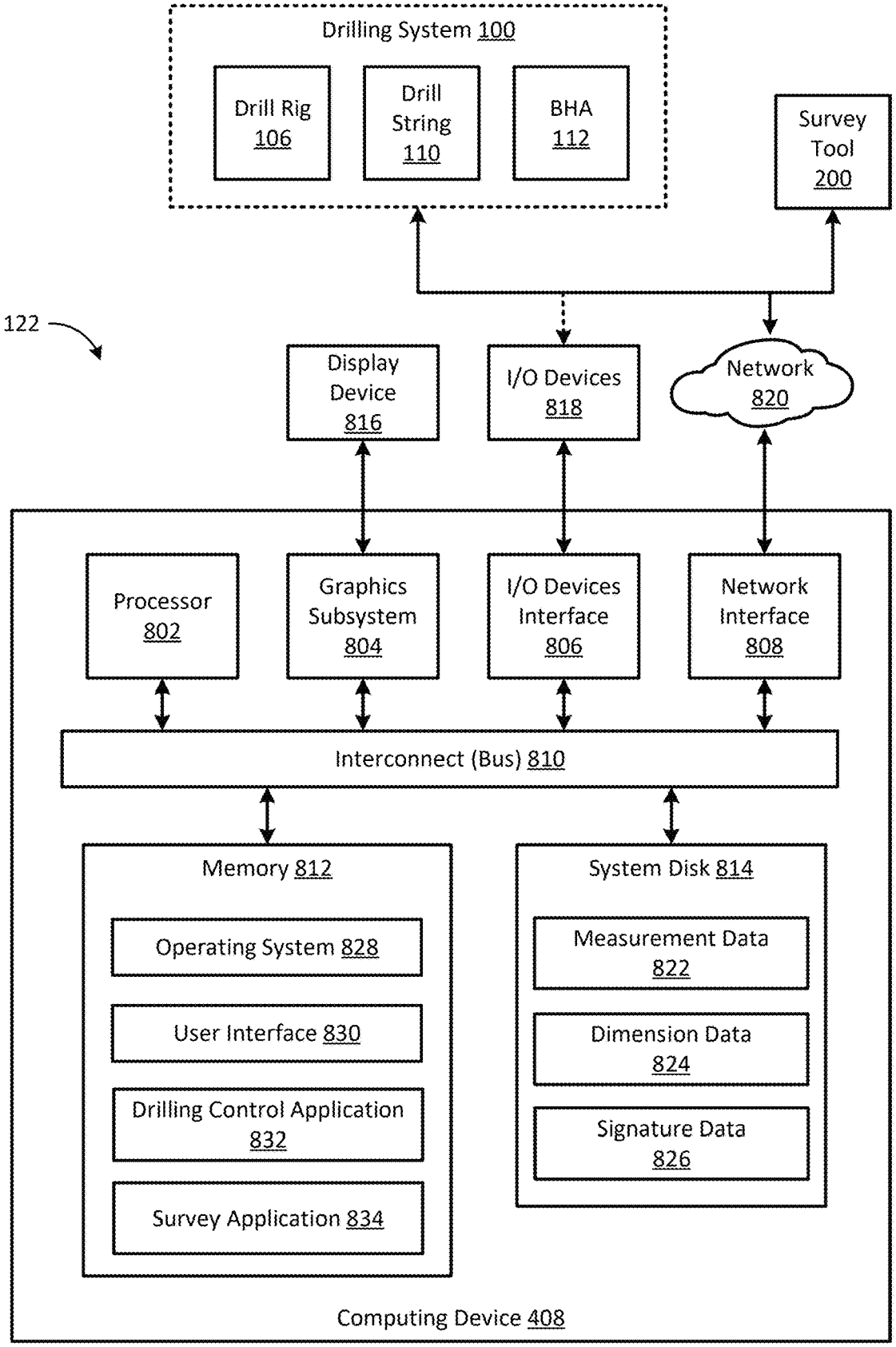
FIG. 8 is a block diagram of a control system implemented in conjunction with the drilling system of FIG. 1, according to various embodiments.

FIG. 8 is a block diagram of the control system 122 implemented in conjunction with the drilling system 100 of FIG. 1, according to various embodiments. In the illustrated example of FIG. 8, the control system 122 includes the drill rig 106, the drill string 110, the BHA 112, the survey tool 200, and a computing device 408. However, persons skilled in the art should understand that in other examples, the control system 122 can includes additional components not shown in FIG. 8 and/or can include less components than the components shown in FIG. 8.

The computing device 408 can be implemented as, for example, a smartphone, a tablet, a laptop, a desktop computer, a server and/or any other suitable computing device. Persons skilled in the art will understand that the computing device 408 shown in FIG. 8 provides just one non-limiting example architecture that can be used to implement the computing device 408 included in the control system 122. Moreover, other suitable computing devices not described herein may be used to implement the computing device 408. In some examples, the computing device 408 is located onsite at the drilling system 100. In other examples, the computing device 408 is located offsite at a remote location.

As shown in FIG. 8, the computing device 408 can include, without limitation, a processor 802, a graphics subsystem 804, an I/O devices interface 806, a network interface 808, an interconnect 810, a memory subsystem 812, and a system disk 814. The interconnect, or bus, 810 can include one or more wires, cables, traces, contacts, analog components, digital components, wireless connection components, and/or other suitable means for interconnecting hardware components of the computing device 408.

In some embodiments, the processor 802 (e.g., a CPU or similar processor) is adapted to retrieve and execute programming instructions stored in the memory subsystem 812. Similarly, the processor 802 is adapted to store and retrieve application data (e.g., software libraries) residing in the memory subsystem 812 and/or the system disk 814. The interconnect 810 is adapted to facilitate transmission of data, such as programming instructions and application data, between the processor 802, the graphics subsystem 804, the I/O devices interface 806, the network interface 808, the memory subsystem 812, and the system disk 814.

In some embodiments, the graphics subsystem 804 is adapted to generate frames of image and/or video data and transmit the frames of image and/or video data to display device 816. In some embodiments, the graphics subsystem 804 may be integrated into an integrated circuit, along with the processor 802. The display device 816 may comprise any technically feasible means for generating an image for display. For example, the display device 816 may be fabricated using liquid crystal display (LCD) technology, cathode-ray technology, and light-emitting diode (LED) display technology. The display device 816 may include, for example, one or more monitors.

The input/output (I/O) devices interface 806 is adapted to receive input data from user I/O devices 818 and transmit the input data to the processor 802 via the interconnect 810. For example, user I/O devices 818 may comprise one or more buttons, a touchscreen, a keyboard, and a mouse or other pointing device. The I/O devices interface 406 also includes an audio output unit adapted to generate an electrical audio output signal. User I/O devices 818 may comprise one or more speakers adapted to generate an acoustic output in response to the electrical audio output signal.

In alternative embodiments, the display device 816 may include the speaker. In some examples, the I/O devices 818 can include the survey tool 200. In such examples, the I/O device interface 806 receives the measurement data stored in the memory 404 of the survey tool 200 directly from the survey tool 200 (e.g., via a wired connection). In some examples, the I/O devices interface 806 can be connected to one or more of the drill rig 106, the drill string 110, and/or the BHA 112. In some examples, the I/O devices interface 806 can be connected to one or more of telemetry equipment, an LWD module, and MWD module, and/or the directional drilling assembly 120 included in the BHA 112 and/or the drill string 110. In some examples, the computing device 408 can receive, via the I/O devices interface 806, well log data and/or other measurements generated by the LWD module and/or the MWD module. In some examples, the computing device 408 can transmit, via the I/O devices interface 806, commands for controlling drilling to the BHA 112.

The network interface 808 is adapted to transmit and receive packets of data via one or more network connections 820. For example, the network interface 808 is adapted to receive, via one or more network connections 820, measurement data from the survey tool 200. As another example, the network interface 808 is adapted to receive, via one or more network connections 820, well log data and/or other measurement data from one or more of the LWD module and/or the MWD module included in the BHA 112. As another example, the network interface 808 is adapted to transmit, via one or more network connections 820, one or more signals for controlling drilling to the directional drilling assembly 120. In some examples, the network interface 808 is adapted to communicate, via one or more network connections 820, with one or more external computing devices.

The one or more network connections 820 can be established, for example, via one or more of a wide area network (WAN) (e.g., the Internet, a TCP/IP based network, a cellular network, such as, for example, a Global System for Mobile Communications [GSM] network, a General Packet Radio Services [GPRS] network, a Code Division Multiple Access

[CDMA] network, an Evolution-Data Optimized [EV-DO] network, an Enhanced Data Rates for GSM Evolution [EDGE] network, a 3 GSM network, a 4GSM network, a Digital Enhanced Cordless Telecommunications [DECT] network, a Digital AMPS [IS-136/TDMA] network, or an Integrated Digital Enhanced Network [iDEN] network, etc.). In other examples, the one or more network connections 820 are established using a local area network (LAN), a neighborhood area network (NAN), a home area network (HAN), and/or a personal area network (PAN) employing any of a variety of communications protocols, such as Wi-Fi, Bluetooth, ZigBee, etc. In some examples, the one or more network connections 420 are established using one or more of a wide area network (WAN), a local area network (LAN), a neighborhood area network (NAN), a home area network (HAN), or personal area network (PAN). In some examples, the one or more network connections 820 are established using wired connections.

The system disk 814, such as a hard disk drive or flash memory storage drive, is adapted to store non-volatile data. For example, the system disk 814 stores one or more files, applications, and/or programs to be implemented by the processor 802. In some examples, the system disk 814 stores measurement data generated by and received from the survey tool 200. In some examples, the measurement data 822 includes sensor data that was generated by an axial accelerometer of the survey tool 200 and that can be used to determine times at which the survey tool 200 moves through pipe joints 118 and/or depths of the survey tool 200 moving through the drill pipe 200. In some examples, the measurement data 822 includes sensor data that was generated by an accelerometer and/or a gyroscope of the survey tool 200 that can be used to determine orientation information, such as continuous azimuth and/or inclination, of the survey tool 200 moving through the drill pipe 118. In some examples, the measurement data 822 includes gyrocompass survey data that was generated by a gyroscope of the survey tool 200 during retrieval of the survey tool 200 from the wellbore 102.

In some examples, the system disk 814 further stores dimension data 824 and signature data 826. The dimension data 824 can include, for example, one or more dimensions of the survey tool 200. For example, the dimension data 824 can include data indicative of the length, or distance, between centralizers 208 of the survey tool 200, a total length of the survey tool 200, and/or one or more other dimensions of the survey tool 200. The dimension data 824 can also include, for example, one or more dimensions associated with the drill pipe 116 and/or pipe joints 118. For example, the dimension data 824 can include the lengths of segments of drill pipe 116, the length of pipe joints 118, the distance spanned by a segment of drill pipe 116 between pipe joints 118, and/or other dimensions associated with the drill pipe 116 and/or pipe joints 118.

As will be described in more detail herein, the signature data 826 can include information associated with the spacings s between spikes in a spike group 602 appearing in a measurement signal (e.g., measurement signal 600) generated by an axial accelerometer. This information can include, for example, minimum and maximum spacing values $S_{min}$ and $S_{max}$. In some examples, the signature data 826 can also include information associated with the periods P between consecutive spike groups 602 appearing in a measurement signal.

In some examples, the memory subsystem 412 includes programming instructions and application data that comprise an operating system 828, a user interface 830, a drilling control application 832, and a survey application 834. The operating system 828 performs system management functions such as managing hardware devices including graphics subsystem 804, I/O devices interface 806, the network interface 808, and system disk 814. The operating system 828 also provides process and memory management models for the user interface 830, the drilling control application 832, and/or the survey application 834. The user interface 830, such as a window and object metaphor, provides a mechanism for user interaction with computing device 408. Persons skilled in the art will recognize the various operating systems and user interfaces that are well-known in the art and suitable for incorporation into the computing device 408.

When executed by the processor 802, the drilling control application 832 can be used to control one or more parameters of a drilling operation. For example, the drilling control application 832 can be used to control the BHA 112 and/or the directional drilling assembly 120 to perform a drilling operation as described herein. In some examples, the drilling control application 832 uses well log data and/or other measurement data generated by an LWD module and/or an MWD module to control a drilling operation. In some examples, the drilling control application 832 provides an interface through which an operator at the drill rig 106 can interact with the drilling control application 832 to control a drilling operation. For example, the drilling control application 832 enables an operator at the drill rig 106 to input one or more command for controlling a drilling operation via the I/O devices 818.

When executed by the processor 802, the survey application 834 can determine, based in part on measurement data 822 received from the survey tool 200, orientation information and/or depth information associated with the survey tool 200 as the survey tool 200 moved through drill pipe 116. For example, based in part on measurement data 822 generated by an accelerometer and/or a gyroscope included in the first and/or second sensor modules 210A, 210B (e.g., during a drop of the survey tool 200 and/or a retrieval of the survey tool 200), the survey application 834 can determine the continuous azimuth and/or inclination of the survey tool 200 as the survey tool 200 moved through the drill pipe 116. As another example, based in part on measurement data 822 generated by an accelerometer and/or a gyroscope included in the first and/or second sensor modules 210A, 210B, the survey application 834 can determine the orientation angle(s) of the survey tool 200 as the survey tool 200 moved through the drill pipe 116. As another example, based in part on (i) measurement data 822 generated by an axial accelerometer included in the first and/or second sensor modules 210A, 210B and (ii) dimension data 824 associated with the drill pipe 116 and/or the survey tool 200, the survey application 834 can determine the depth(s) of the survey tool 200 as the survey tool 200 moved through the drill pipe 116.

Hereinafter, the determined depth(s) of the survey tool 200 as the survey tool 200 moved through the drill pipe 116 can simply be referred to as the "depth(s) of the survey tool 200." Similarly, hereinafter, the determined continuous azimuth and/or inclination of the survey tool 200 as the survey tool 200 moved through the drill pipe 116 can be referred to as the "continuous azimuth and/or inclination of the survey tool 200." Moreover, the determined orientation information associated with the survey tool 200 as the survey tool 200 moved through the drill pipe 116 can hereinafter be referred to as the "orientation information associated with the survey tool 200."

In some examples, the survey application 834 can also determine a trajectory of the wellbore 102 based in part on the (i) the continuous azimuth and/or inclination of the survey tool 200 and/or (ii) the depth(s) of the survey tool 200. In such examples, the survey application 834 can map, or assign, determined depths of the survey tool 200 to the determined continuous azimuth and/or inclination of the survey tool 200 to determine the trajectory of the wellbore 102.

Although the survey application 834 is described herein as being executed on the computing device 408, in some examples, the functions described herein as being performed by the survey application 834 can also be performed directly by the controller 400 of the survey tool 200. For example, the controller 400 can determine one or more of the continuous azimuth and/or inclination of the survey tool 200 based on measurement data generated by the first and/or second sensor modules 210A, 210B, the depth(s) of the survey tool 200 based in part on measurement data generated by an axial accelerometer included in the first and/or second sensor modules 210A, 210B, and/or a trajectory of the wellbore 102 based in part on the continuous azimuth and/or inclination of the survey tool 200 and the depth(s) of the survey tool 200. Moreover, in some examples, the controller 400 can be adapted to perform one or more of the techniques and/or methods described hereinafter as being performed in part by the survey application 834.

As described herein, a measurement signal (e.g., measurement signal 600) generated by an axial accelerometer included in the first and/or second sensor modules 210A, 210B includes spike groups 602 that correspond to movement of the survey tool 200 through respective pipe joints 118 that connect the segments of drill pipe 116. For example, a first spike group 602 appearing in the measurement signal 600 corresponds to movement of the survey tool 200 through a first pipe joint 118 (e.g., pipe joint 118A) and a second spike group 602 appearing in the measurement signal 600 corresponds to movement of the survey tool 200 through a second pipe joint 118 (e.g., pipe joint 118B). In that regard, the survey tool 200 can determine the time(s) at which the survey tool 200 passed through the first pipe joint 118 based on the time(s) the first spike group 602 appears in the measurement signal 600 and can determine the time(s) at which the survey tool 200 passed through the second pipe joint 118 based on the time(s) at which the second spike group 602 appears in the measurement signal 600.

Furthermore, the spacing between consecutive spike groups 602 appearing in a measurement signal 600 corresponds to the time during which the survey tool 200 moved through a segment of drill pipe 116 (e.g., segment of drill pipe 116B) connected between the consecutive pipe joints 118 (e.g., pipe joints 118A and 118B) in the drill string 110. In that regard, the survey application 834 can determine the depth(s) of the survey tool 200 at various times during movement of the survey tool 200 through the drill pipe 116 based in part on (i) the time(s) at which a first spike group 602 appears in the measurement signal 600, (ii) the time(s) at which a second spike group 602 appears in the measurement signal 600, and/or (iii) known dimensions of the drill pipe 116 (e.g., the length of a segment of drill pipe 116 between consecutive pipe joints 118) and/or known dimensions of the survey tool 200 (e.g., length of the survey tool 200, distance between centralizers 208 on the survey tool 200, etc.). For example, the survey application 834 can determine how many segments of drill pipe 116 the survey tool 200 has moved through at a given time based in part on the number of spike groups 602 detected in the measurement signal 600. Then, using known lengths of the segments of drill pipe 116, the survey application 834 can estimate the depth of the survey tool 200 at a given time based in part on a determined number of segments of drill pipe 116 that have been traversed by the survey tool 200.

Figure 9:
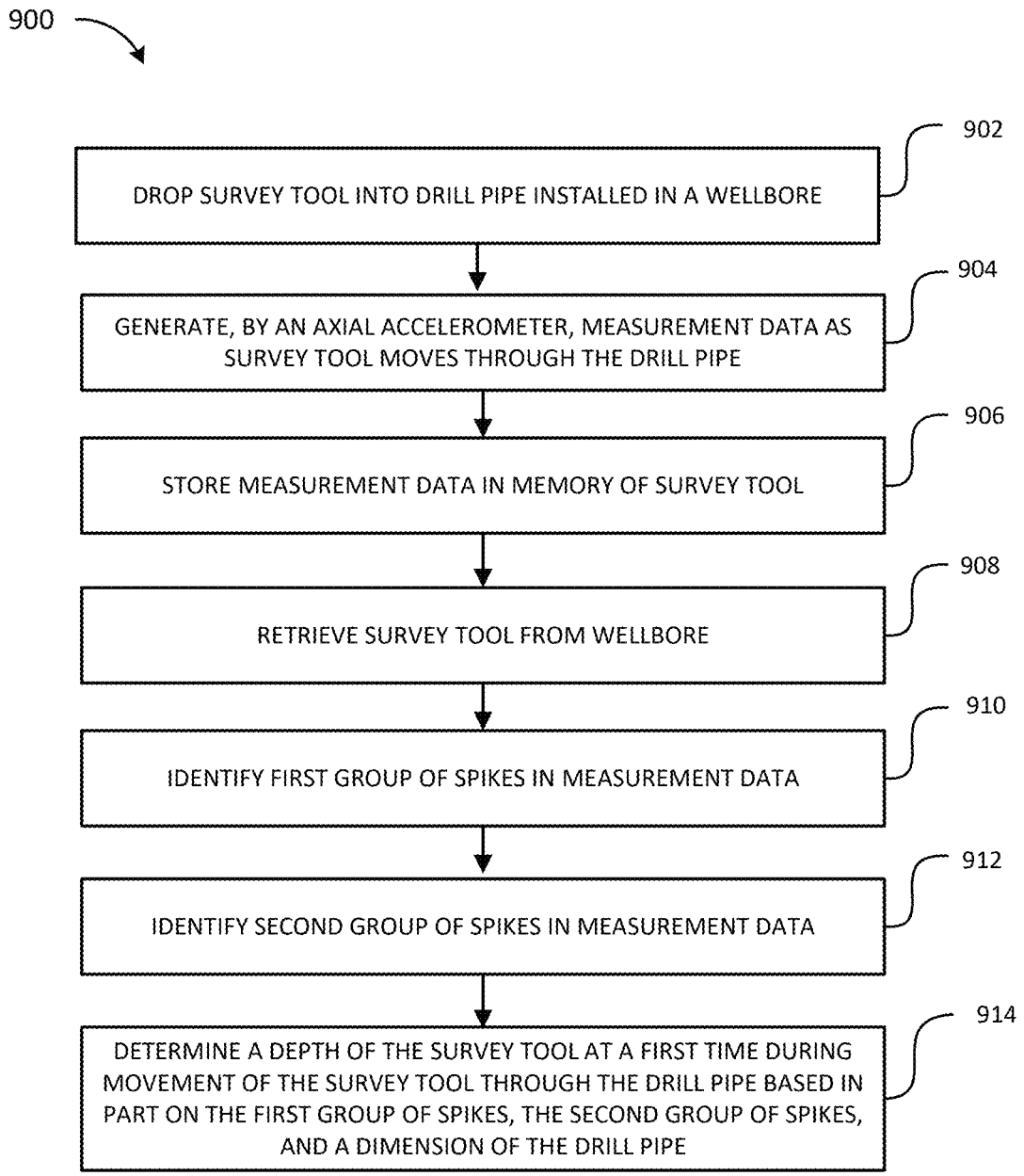
FIG. 9 is a flow diagram of method steps for estimating depth of a survey tool during a wellbore survey, according to various embodiments.

FIG. 9 is a flow diagram of method steps for estimating depth of a survey tool during a wellbore survey, according to various embodiments. Although the method steps are described in conjunction with the systems of FIGS. 1-8, persons skilled in the art will understand that any system configured to perform the method steps, in any order, is within the scope of the present disclosure.

As shown, a method 900 begins at step 902, at which a survey tool is dropped inside a drill pipe placed in a wellbore. For example, the survey tool 200 is dropped inside the drill pipe 116 placed in the wellbore 102.

At step 904, measurement data is generated by an axial accelerometer as the survey tool moves through the drill pipe. For example, an axial accelerometer included in the first and/or second sensor modules 210A, 210B generates a measurement signal 600 as the survey tool 200 moves through segments of the drill pipe 116 and pipe joints 118 that connect the segments of the drill pipe 116.

At step 906, the measurement data is stored in a memory of the survey tool. For example, the measurement signal 600 is stored in the memory 404 of the survey tool 200.

At step 908, the survey tool is retrieved from the wellbore. For example, the survey tool 200 is retrieved from the wellbore 102, such as in the example shown in FIGS. 7A-7D.

At step 910, a first group of spikes is identified in the measurement data. For example, the survey application 834 running on the computing device 408 receives the measurement signal 600 from the survey tool 200 and identifies, using one or more signal processing techniques (e.g., cross correlation, spectral estimation, etc.), a first spike group 602 appearing in the measurement signal 600. As described herein, a spike group 602 includes multiple (e.g., 3) spikes that correspond to respective centralizers 208 of the survey tool 200 passing through a pipe joint 118.

At step 912, a second group of spikes is identified in the measurement data. For example, the survey application 834 identifies, using one or more signal processing techniques (e.g., cross correlation, spectral estimation, etc.), a second spike group 602 appearing in the measurement signal 600. In some examples, the first spike group 602 identified at step 910 and the second spike group 602 identified at step 912 appear consecutively in the measurement signal 600.

At step 914, a depth of the survey tool at first time during movement of the survey tool through the drill pipe is determined based in part on the first group of spikes, the second group of spikes, and a dimension of the drill pipe. For example, the survey application 834 determines, based in part on (i) the time(s) at which the first spike group 602 appears in the measurement signal 600, (ii) the time(s) at which the second spike group 602 appears in the measurement signal 600, and (iii) a known length of a segment of drill pipe 116, a depth of the survey tool 200 at a first time during movement of the survey tool 200 through the drill pipe 116.

As described herein, when estimating and/or determining the depth(s) of the survey tool 200, the survey application 834 can identify spike groups 602 in a measurement signal 600 generated by an axial accelerometer included in the survey tool 200 (e.g., in the first and/or second sensor modules 210A, 210B), these spike groups 602 corresponding to movement, or passage, of the survey tool 200 through pipe joint 118 that connect segments of drill pipe 116. To avoid misidentifying noise in the measurement signal 600 as a spike group 602 and/or missing a spike group 602 appearing the measurement signal 600, the survey application 834 can implement one or more signal processing techniques to automatically identify, or detect, spike groups 602 appearing in a measurement signal 600.

In some examples, the survey application 834 analyzes the measurement signal 600 by looking for signatures in the measurement signal that look like a spike group 602. FIG. 10A illustrates an example signature 1000A of a spike group 602 that can appear in a measurement signal 600 generated by an axial accelerometer of the survey tool 200. As shown in the illustrated example of FIG. 10A, the signature 1000A includes three uniformly spaced spikes 1002A-1002C, where each of the three uniformly spaced spikes 1002A-1002C corresponds to movement of a respective one of the three centralizers 208 included in the survey tool 200 through a pipe joint 118. For example, the first spike 1002A corresponds to movement of a first centralizer 208 through a pipe joint 118, the second first spike 1002B corresponds to movement of a second centralizer 208 through a pipe joint 118, and the third spike 1002C corresponds to movement of a third centralizer 208 through a pipe joint 118. The spacing, s, between spikes 1002 in the signature 1000A corresponds to the spacing, or length, between centralizers 208 on the survey tool 200. The signature 1000A can be saved as a template signature in the signature data 826 and used by the survey application 834 to analyze measurement signals 600 generated by an axial accelerometer of the survey tool 200.

Persons skilled in the art should understand that the signature 1000A shown in the illustrated example of FIG. 10A corresponds to a survey tool 200 that includes three centralizers 200. However, in other examples in which a survey tool includes a different number of centralizers 208 (e.g., 2, 4, 5, etc.), the corresponding signature for the spike group 602 will include a number of spikes equal to the number of centralizers 208.

Figure 10B:
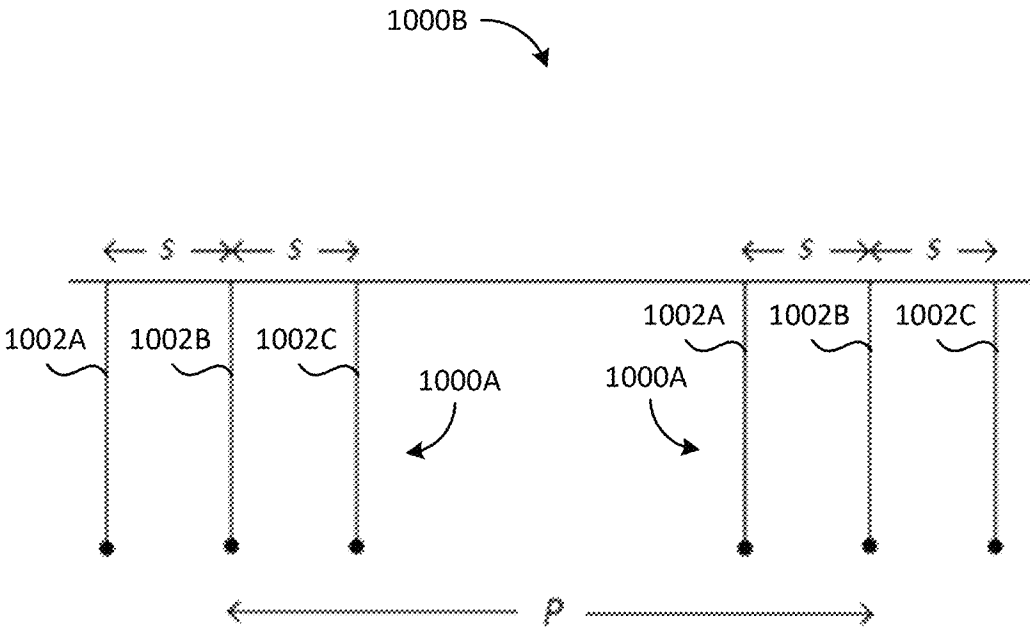
FIG. 10B illustrates an example signature for consecutive spike groups appearing in a measurement signal generated by an axial accelerometer of the survey tool, according to various embodiments.
Figure 10A:
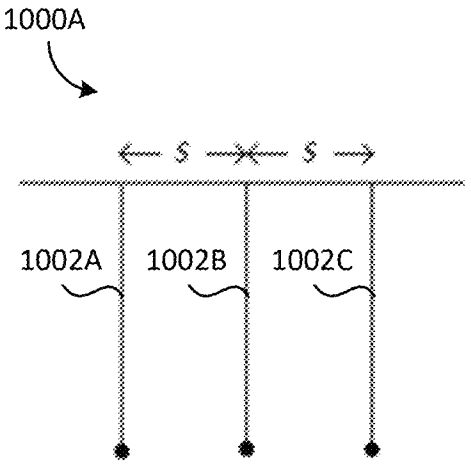
FIG. 10A illustrates an example signature of a spike group that can appear in a measurement signal generated by an axial accelerometer of the survey tool, according to various embodiments.

FIG. 10B illustrates an example signature 1000B for consecutive spike groups 602 appearing in a measurement signal 600 generated by an axial accelerometer of the survey tool 200. As shown in the illustrated example of FIG. 10B, the signature 1000B includes a first signature 1000A of three uniformly spaced spikes 1002A-1002C, where each of the three uniformly spaced spikes 1002A-1002C corresponds to movement of a respective one of the three centralizers 208 included in the survey tool 200 through a first pipe joint 118 (e.g., pipe joint 118A), and a second signature 1000A of three uniformly spaced spikes 1002A-1002C, where each of the three uniformly spaced spikes 1002A-1002C corresponds to movement of a respective one of the three centralizers 208 included in the survey tool 200 through a second pipe joint 118 (e.g., pipe joint 118B). The period, P, between the first and second signatures 1000A shown in FIG. 10B corresponds to the length of the segment of drill pipe 116 connected between the first and second pipe joints 118A, 118B. The signature 1000B can be saved as a template signature in the signature data 826 and used by the survey application 834 to analyze measurement signals 600 generated by an axial accelerometer of the survey tool 200.

In a measurement signal 600 generated by an axial accelerometer included in the survey tool 200, the spacing, s, between the spikes in spike group 602 and the period, P, between consecutive spike groups 602 appearing in the measurement signal 600 depend on the speed of the survey tool 200 as the survey tool 200 moves down the drill pipe 116. As the speed of the survey tool 200 increases through the drill pipe 116, the spacing, s, between the spikes in a spike group 602 and the period, P, between consecutive spike groups 602 reduce proportionally.

Furthermore, the period, P, between consecutive spike groups 602 depends on the length of the segment of drill pipe 116 between consecutive pipe joints 118, and the spacing, s, between the spikes in a spike group 602 depends on the spacing, or distance, between centralizers 208 on the survey tool 200. Therefore, with a given length of a segment of drill pipe 116 and a given distance between centralizers 208 on the survey tool 200, there is a one-to-one correspondence between the period, P, between consecutive spike groups 602 and the spacing, s, between spikes in a spike group 602. In that regard, the ratio of s to P is equal to the ratio of the distance between centralizers 208 to the distance between pipe joints 118 (e.g., length of a segment of drill pipe 116), and thus, specifying s also specifies P, and vice versa.

In some examples, the survey application 834 can computes a cross correlation between the measurement signal 600 and the signatures 1000A, 1000B to identify, or detect, the spike groups 602 appearing in the measurement signal 600. A cross correlation between signals is a measure of how closely the shapes of the signals match. Therefore, a spike group 602 is detected in the measurement signal 600 whenever a cross correlation between the measurement signal 600 and the signatures 1000A and/or 1000B is determined to exceed a similarity threshold.

Because the speed of the survey tool 200 moving through the drill pipe 116 is unknown, the optimal size for the spacing, s, and/or the period, P, included the signatures 1000A, 1000B cannot easily be determined and may differ depending on the wellbore 102. Thus, instead of using a single signature 1000A, 1000B that includes single values for the spacing, s, and period, P, a bank of signatures can be stored in the signature data 826 and used by the survey application 834 to detect spike groups 602 in a measurement signal 600. The bank of signatures includes a plurality of signatures 1000A, 1000B with different spacings, s, between spikes 1002 starting at $s=S_{min}$ and increasing to $s=S_{max}$, where $S_{min}$ and $S_{max}$ are the minimum and maximum spacings, s, possible, respectively.

For examples in which the survey application 834 uses a bank of signatures, the survey application 834 can perform a cross correlation between the measurement signal 600 and each signature 1000A and/or 1000B include in the bank of signatures. It is important that the bank of signatures encompasses all reasonably possible spike spacings, s, to reduce the likelihood that the spike groups 602 in the measurement signal 600 go undetected. However, having a high number of signatures 1000A, 1000B in the bank of signatures increase the likelihood of 'false' detections of spike groups 602 in the measurement signal 600. Thus, because there is a one-to-tone correspondence between the spacing, s, between spikes in a spike group 602 and the periods, P, between consecutive spike groups 602, the number of signatures 1000A, 1000B that need to be included in a bank of signatures can be reduced if a reliable initial estimate of the period, P, is available thereby allowing for a narrower range of spacings, s. In some examples, the survey application 834 can implement one or more spectral estimation techniques, for example, a periodogram, to provide an initial estimate for the period, P, between spike groups 602 appearing in the measurement signal 600 generated by the axial accelerometer included in the survey tool 200. In some examples, the survey application 834 can update the values of the spacings, s, and/or the periods, P, of the signatures 1000A, 1000B included in the bank of signatures to accommodate for changing speeds of the survey tool 200.

Figure 11:
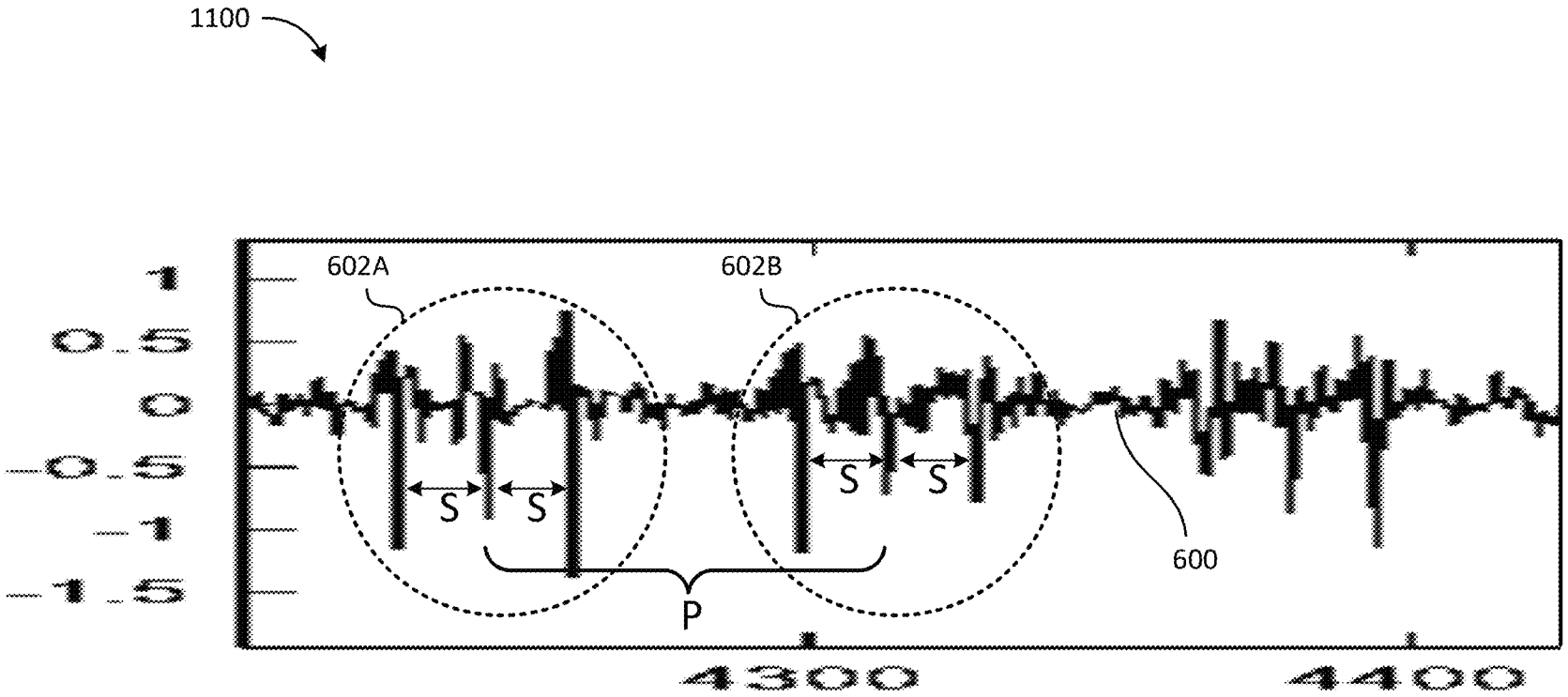
FIG. 11 illustrates a portion of the example measurement signal shown in FIG. 6, according to various embodiments.

FIG. 11 illustrates a portion 1100 of the example measurement signal 600 shown in FIG. 6, according to various embodiments. In the illustrated example of FIG. 11, the survey application 834 performed a cross correlation between the measurement signal 600 and the signatures 1000A and/or 1000B included in the bank of signatures (e.g., signature data 826) to identify, or detect, the first and second spike groups 602A, 602B appearing in the measurement signal 600.

As described herein, in some examples, the survey application 834 can also determine a trajectory of the wellbore 102 based in part on the (i) the continuous azimuth and/or inclination of the survey tool 200 and/or (ii) the depth(s) of the survey tool 200. In such examples, the survey application 834 can map, or assign, determined depths of the survey tool 200 to the determined continuous azimuth and/or inclination of the survey tool 200 to determine the trajectory of the wellbore 102.

Figure 12:
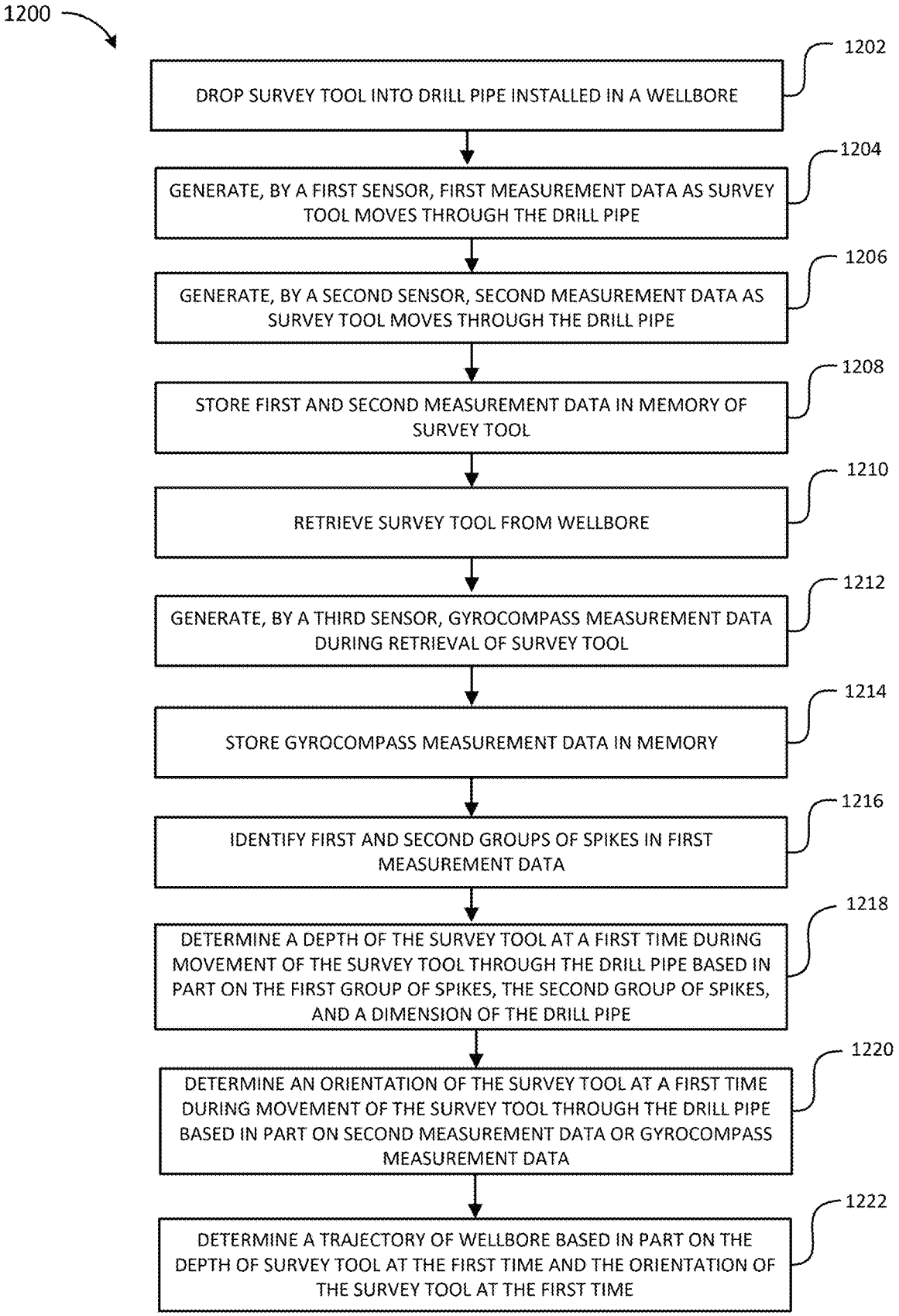
FIG. 12 is a flow diagram of method steps for determining a trajectory of a wellbore, according to various embodiments.

FIG. 12 is a flow diagram of method steps for determining a trajectory of a wellbore, according to various embodiments. Although the method steps are described in conjunction with the systems of FIGS. 1-11, persons skilled in the art will understand that any system configured to perform the method steps, in any order, is within the scope of the present disclosure.

As shown, a method 1200 begins at step 1202, at which a survey tool is dropped inside a drill pipe placed in a wellbore. For example, the survey tool 200 is dropped inside the drill pipe 116 placed in the wellbore 102.

At step 1204, first measurement data is generated by a first sensor as the survey tool moves through the drill pipe. For example, an axial accelerometer included in the first and/or second sensor modules 210A, 210B generates a measurement signal 600 as the survey tool 200 moves through segments of the drill pipe 116 and pipe joints 118 that connect the segments of the drill pipe 116.

At step 1206, second measurement data is generated by a second as the survey tool moves through the drill pipe. For example, a 3-axis accelerometer and/or a gyroscope included in the first and/or second sensor modules 210A, 210B generates measurement data indicative of the orientation of the survey tool 200 as the survey tool 200 moves through segments of the drill pipe 116 and pipe joints 118 that connect the segments of the drill pipe 116.

At step 1208, the first and second measurement data is stored in a memory of the survey tool. For example, the measurement signal 600 and the second measurement data generated at step 1206 are stored in the memory 404 of the survey tool 200.

At step 1210, the survey tool is retrieved from the wellbore. For example, the survey tool 200 is retrieved from the wellbore 102, such as in the example shown in FIGS. 7A-7D.

At step 1212, gyrocompass measurement data is generated by a third sensor as the survey tool is retrieved from the wellbore. For example, a gyroscope included in the first and/or second sensor modules 210A, 210B generates gyrocompass survey data during retrieval of the survey tool 200 from the wellbore 102. In some examples, the third sensor is the same sensor as the second sensor and/or the first sensor.

At step 1214, the gyrocompass measurement data is stored in a memory of the survey tool. For example, the gyrocompass measurement data is stored in the memory 404 of the survey tool 200.

At step 1216, first and second groups of spikes are identified in the first measurement data. For example, the survey application 834 running on the computing device 408 identifies, using one or more signal processing techniques (e.g., cross correlation, spectral estimation, etc.), a first spike group 602A and a second spike group 602B appearing in the measurement signal 600.

At step 1218, a depth of the survey tool at first time during movement of the survey tool through the drill pipe is determined based in part on the first group of spikes, the second group of spikes, and a dimension of the drill pipe. For example, the survey application 834 determines, based in part on (i) the time(s) at which the first spike group 602 appears in the measurement signal 600, (ii) the time(s) at which the second spike group 602 appears in the measurement signal 600, and (iii) a known length of a segment of drill pipe 116, a depth of the survey tool 200 at a first time during movement of the survey tool 200 through the drill pipe 116.

At step 1220, an orientation of the survey tool at first time during movement of the survey tool through the drill pipe is determined based in part on the second measurement data and/or the gyrocompass measurement data. For example, the survey application 834 determines, based in part on the second measurement data and/or the gyrocompass measurement data, an azimuth and/or an inclination of the survey tool 200 at a first time during movement of the survey tool through the drill pipe 116.

At step 1222, a trajectory of a wellbore is determined based in part on the depth of the survey tool at the first time and the orientation of the survey tool at the first time. For example, the survey application 834 determines the trajectory of the wellbore 102 based in part on the depth of the survey tool 200 at the first time and the orientation (e.g., azimuth and inclination) of the survey tool 200 at the first time. In some examples, the survey application 834 maps the depth of the survey tool 200 at the first time to the orientation of the survey tool 200 at the first time when determining the trajectory of the wellbore 102.

Although certain aspects have been described with reference to certain examples, variations and modifications exist within the spirit and scope of one or more independent aspects. Various features and aspects are set forth in the following claims.

Any and all combinations of any of the claim elements recited in any of the claims and/or any elements described in this application, in any fashion, fall within the contemplated scope of the present disclosure and protection. The descriptions of the various embodiments have been presented for purposes of illustration, but are not intended to be exhaustive or limited to the embodiments disclosed. Many modifications and variations will be apparent to those of ordinary skill in the art without departing from the scope and spirit of the described embodiments.

Any combination of one or more computer readable medium(s) may be utilized. The computer readable medium may be a computer readable signal medium or a computer readable storage medium. A computer readable storage medium may be, for example, but not limited to, an electronic, magnetic, optical, electromagnetic, infrared, or semiconductor system, apparatus, or device, or any suitable combination of the foregoing. More specific examples (a non-exhaustive list) of the computer readable storage medium would include the following: an electrical connection having one or more wires, a portable computer diskette, a hard disk, a random access memory (RAM), a read-only memory (ROM), an erasable programmable read-only memory (EPROM or Flash memory), an optical fiber, a portable compact disc read-only memory (CD-ROM), an optical storage device, a magnetic storage device, or any suitable combination of the foregoing. In the context of this document, a computer readable storage medium may be any tangible medium that can contain, or store a program for use by or in connection with an instruction execution system, apparatus, or device.

Aspects of the present disclosure are described above with reference to flowchart illustrations and/or block diagrams of methods, apparatus (systems) and computer program products according to embodiments of the disclosure. It will be understood that each block of the flowchart illustrations and/or block diagrams, and combinations of blocks in the flowchart illustrations and/or block diagrams, can be implemented by computer program instructions. These computer program instructions may be provided to a processor of a general purpose computer, special purpose computer, or other programmable data processing apparatus to produce a machine.

The instructions, when executed via the processor of the computer or other programmable data processing apparatus, enable the implementation of the functions/acts specified in the flowchart and/or block diagram block or blocks. Such processors may be, without limitation, general purpose processors, special-purpose processors, application-specific processors, or field-programmable gate arrays.

The flowchart and block diagrams in the figures illustrate the architecture, functionality, and operation of possible implementations of systems, methods and computer program products according to various embodiments of the present disclosure. In this regard, each block in the flowchart or block diagrams may represent a module, segment, or portion of code, which comprises one or more executable instructions for implementing the specified logical function(s). It should also be noted that, in some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts, or combinations of special purpose hardware and computer instructions.

While the preceding is directed to embodiments of the present disclosure, other and further embodiments of the disclosure may be devised without departing from the basic scope thereof, and the scope thereof is determined by the claims that follow.

What is claimed is:

1. A method for estimating the depth of a survey tool during a wellbore survey, the method comprising:

dropping the survey tool inside a drill pipe placed in a wellbore, wherein the survey tool includes a first centralizer, a second centralizer, and a third centralizer;

generating, by an accelerometer included in the survey tool, measurement data as the survey tool moves through the drill pipe;

identifying a first group of spikes appearing in the measurement data, wherein:

the first group of spikes includes a first spike, a second spike, and a third spike;

the first spike corresponds to a first disturbance caused by movement of the first centralizer through a pipe joint;

the second spike corresponds to a second disturbance caused by movement of the second centralizer through the pipe joint; and the third spike corresponds to a third disturbance caused by movement of the third centralizer through the pipe joint;

identifying a second group of spikes appearing in the measurement data; and determining a depth of the survey tool at a first time during movement of the survey tool through the drill pipe based in part on the first group of spikes, the second group of spikes, and a dimension of the drill pipe.

2. The method of claim 1, wherein the first group of spikes corresponds to movement of the survey tool through a first pipe joint; and wherein the second group of spikes corresponds to movement of the survey tool through a second pipe joint.

3. The method of claim 2, wherein the dimension of the drill pipe is a length of the drill pipe between the first pipe joint and the second pipe joint.

4. The method of claim 1, wherein a spacing in the measurement data between the first spike and the second spike corresponds to a distance between the first centralizer and the second centralizer.

5. The method of claim 1, wherein a spacing in the measurement data between the first group of spikes and the second group of spikes corresponds to a length of the drill pipe.

6. The method of claim 1, wherein identifying the first group of spikes including computing a cross correlation between the measurement data and a spike group signature.

7. The method of claim 1, further comprising storing the measurement data in a memory of the survey tool.

8. The method of claim 1, further comprising retrieving the survey tool from the wellbore.

9. A system, comprising:

a drill pipe placed in a wellbore, the drill pipe including a segment of drill pipe connected between a first pipe joint and a second pipe joint;

a survey tool adapted to be dropped inside the drill pipe, the survey tool including;

an axial accelerometer adapted to generate measurement data during movement of the survey tool through the drill pipe;

a first centralizer adapted to engage inner walls of the drill pipe;

a second centralizer adapted to engage the inner walls of the drill pipe; and a third centralizer adapted to engage the inner walls of the drill pipe; and a computing device including one or more processors, the computing device adapted to:

receive the measurement data from the survey tool;

identify a first group of spikes appearing in the measurement data, wherein:

the first group of spikes includes a first spike, a second spike, and a third spike;

the first spike corresponds to a first disturbance caused by movement of the first centralizer through a pipe joint;

the second spike corresponds to a second disturbance caused by movement of the second centralizer through the pipe joint; and the third spike corresponds to a third disturbance caused by movement of the third centralizer through the pipe joint;

identify a second group of spikes appearing in the measurement data; and determine a depth of the survey tool at a first time during movement of the survey tool through the drill pipe based in part on the first group of spikes, the second group of spikes, and a dimension of the drill pipe.

10. The system of claim 9, wherein:

the first group of spikes corresponds to movement of the survey tool through the first pipe joint;

the second group of spikes corresponds to movement of the survey tool through the second pipe joint; and the dimension of the drill pipe is a length of the segment of drill pipe.

11. The system of claim 9, wherein a spacing in the measurement data between the first spike and the second spike corresponds to a distance between the first centralizer and the second centralizer; and wherein a period in the measurement data between the first group of spikes and the second group of spikes corresponds to a length of the segment of drill pipe.

12. The system of claim 9, wherein to identify the first group of spikes, the computing device is further adapted to compute a cross correlation between the measurement data and a spike group signature.

13. The system of claim 9, wherein the survey tool further includes a gyroscope adapted to generate measurement data indicative of an orientation of the survey tool during movement of the survey tool through the drill pipe; and wherein the computing device is further adapted to determine, based in part on the measurement data indicative of the orientation of the survey tool, the orientation of the survey tool at the first time during movement of the survey tool through the drill pipe.

14. The system of claim 13, wherein the computing device is further adapted to determine a trajectory of the wellbore based in part on the depth of the survey tool at the first time and the orientation of the survey tool at the first time.

15. The system of claim 9, wherein the survey tool includes a memory adapted to store the measurement data.

16. A method for determining a trajectory of a wellbore, the method comprising:

dropping a survey tool inside a drill pipe placed in the wellbore, wherein the survey tool includes a first centralizer, a second centralizer, and a third centralizer;

generating, by a first sensor included in the survey tool, first measurement data as the survey tool moves through the drill pipe;

generating, by a second sensor included in the survey tool, second measurement data as the survey tool moves through the drill pipe;

retrieving the survey tool from the wellbore;

identifying a first group of spikes appearing in the first measurement data, wherein:

the first group of spikes includes a first spike, a second spike, and a third spike;

the first spike corresponds to a first disturbance caused by movement of the first centralizer through a pipe joint;

the second spike corresponds to a second disturbance caused by movement of the second centralizer through the pipe joint; and the third spike corresponds to a third disturbance caused by movement of the third centralizer through the pipe joint;

identifying a second group of spikes appearing in the first measurement data;

determining a depth of the survey tool at a first time during movement of the survey tool through the drill pipe based in part on the first group of spikes, the second group of spikes, and a dimension of the drill pipe;

determining an orientation of the survey tool at the first time during movement of the survey tool through the drill pipe based in part on the second measurement data; and determining the trajectory of the wellbore based in part on the depth of the survey tool at the first time and the orientation of the survey tool at the first time.

* * * * *